US012343610B2

(12) United States Patent
Swan

(10) Patent No.: US 12,343,610 B2
(45) Date of Patent: Jul. 1, 2025

(54) GOLF SWING AND PUTT ALIGNMENT SYSTEM

(71) Applicant: David Swan, Shell Lake, WI (US)

(72) Inventor: David Swan, Shell Lake, WI (US)

( * ) Notice: Subject to any disclaimer, the term of this patent is extended or adjusted under 35 U.S.C. 154(b) by 491 days.

(21) Appl. No.: 17/570,213

(22) Filed: Jan. 6, 2022

(65) Prior Publication Data

US 2022/0212082 A1 Jul. 7, 2022

Related U.S. Application Data

(60) Provisional application No. 63/293,607, filed on Dec. 23, 2021, provisional application No. 63/134,374, filed on Jan. 6, 2021.

(51) Int. Cl.
*A63B 69/36* (2006.01)

(52) U.S. Cl.
CPC ..... *A63B 69/3676* (2013.01); *A63B 69/3621* (2020.08); *A63B 2225/09* (2013.01)

(58) Field of Classification Search
CPC ..... A63B 69/3676; A63B 69/3621; A63B 2225/09
USPC ..... 473/218, 257, 258, 260, 261–266, 272, 473/273
See application file for complete search history.

(56) References Cited

U.S. PATENT DOCUMENTS

| | | | | | |
|---|---|---|---|---|---|
| 3,791,653 | A * | 2/1974 | Yamada | A63B 69/3676 | 273/127 D |
| 4,718,674 | A * | 1/1988 | Henry | A63B 69/3667 | 473/218 |
| 5,209,484 | A * | 5/1993 | Randall | A63B 69/36211 | 473/265 |
| 5,306,013 | A * | 4/1994 | Germinario | A63B 63/00 | 473/192 |
| 5,435,727 | A * | 7/1995 | Dobson | A63B 69/3667 | 473/218 |
| 5,588,653 | A * | 12/1996 | Robinson | A63B 69/3667 | 473/270 |
| 5,776,007 | A * | 7/1998 | Kendall | A63B 69/3676 | 248/176.1 |
| 6,048,273 | A * | 4/2000 | Clement | A63B 69/3676 | 273/DIG. 21 |
| 6,129,639 | A * | 10/2000 | Brock | A63B 69/36211 | 473/260 |
| 7,037,210 | B2 * | 5/2006 | Bainter | A63B 69/3667 | 473/270 |
| 9,259,635 | B2 * | 2/2016 | Downing | A63B 45/02 | |
| 11,000,749 | B1 * | 5/2021 | Forney | A63B 69/3682 | |
| 2003/0162602 | A1 * | 8/2003 | Tai | A63B 69/3621 | 473/265 |
| 2009/0124406 | A1 * | 5/2009 | Alter | A63B 69/3667 | 473/218 |

* cited by examiner

*Primary Examiner* — Nini F Legesse
(74) *Attorney, Agent, or Firm* — Westman, Champlin & Koehler, P.A.; Amanda M. Prose

(57) ABSTRACT

An alignment device for putting includes two bridges, and at least two rods configured to extend through openings in the bridges to create a putting area bordered by the rods and the bridges. Each bridge includes a pair of base elements, a trestle that extends between the two base elements, a string support that extends from the trestle, and at least one target that is suspended from the trestle.

15 Claims, 18 Drawing Sheets

GOLF SWING AND PUTT ALIGNMENT SYSTEM

CROSS-REFERENCE TO RELATED APPLICATION(S)

This application claims the benefit of U.S. provisional application Nos. 63/134,374, filed on Jan. 6, 2021, and 63/293,607, filed on Dec. 23, 2021, the contents of which are incorporated by reference in their entireties.

BACKGROUND

Golf is a multi-billion dollar annual industry. One of the allures of golf is the ability for nearly anyone to play. In order to continue to improve, certain fundamentals are important, including swing alignment, and putting. If a golfer cannot align the golf swing properly to the target, a golf shot can easily go awry. When putting, alignment can make the difference between one putt of many putts on a hole.

Teaching aids for aligning a swing often are a pair of straight poles or rods that a golfer attempts to properly arrange in order to show a possible swing path. However, such rods cannot be aligned with precision, and their use is therefore contingent upon the skill of alignment that the golfer has. In putting, even a small misalignment may lead to bad putting.

SUMMARY

In one embodiment, an alignment device for putting includes a bridge member having two uprights and a cross member, the uprights spaced a distance apart by the cross member, the cross member having a through opening at a center of the cross member between the uprights. A tube member is attached to each upright at a bottom thereof, the tube members parallel to one another. A pair of rods fit through the tubes, the rods extending parallel to one another when in the tubes.

In additional aspects, the alignment device includes wherein the predetermined distance is a width of a golf hole; or wherein the predetermined distance is a width of a golf hole. The alignment device in another aspect further includes at least a pair of secondary through openings in the cross member equidistant from and to opposite sides of the center opening, the at least a pair of secondary openings spaced a predetermined distance apart. A through opening at the center of the cross members is sized to accommodate a golf tee stem therethrough and to be retained in the opening by a head of the golf tee.

In another embodiment, a method of operating a putting aid as described above includes placing a one of the pair of rods through one of the tubes, and placing another of the pair of rods through the other of the tubes, placing a ball in a lane formed by the pair of rods, aligning feet of a golfer to one of the rods, and aligning a putter in the lane to address the ball with feet aligned to the one of the rods.

In additional aspects, the method further includes placing a tee in the center hole for determining alignment of a putt made by putting the ball once the feet and the putter are aligned; or further includes placing a tee in each of the pair of secondary through openings for determining alignment of a putt made by putting the ball once the feet and the putter are aligned.

In another embodiment, a swing alignment system includes at least two alignment members, each alignment member comprising a first tube configured to accommodate a rod therethrough and a second tube, perpendicular to the first tube, configured to accommodate a rod therethrough. A first rod is configured to slidably engage the first tubes of the at least two alignment members. A second rod is configured to slidably engage the second tube of the first alignment member. A third rod is configured to slidably engage the second tube of the second alignment member to place the second and third rods parallel to one another when engaged with the alignment devices.

In additional aspects, the swing alignment system further includes a third alignment member comprising a first tube configured to accommodate a rod therethrough and a second tube, perpendicular to the first tube, configured to accommodate a rod therethrough. The third alignment member is configured to slidably engage the second rod or the third rod to provide a stance alignment configuration for a golfer's feet.

In another embodiment, a method of operating a swing system as described above includes placing the first rod through the first tube of the first alignment member and the first tube of the second alignment member, placing the second rod through the second tube of the first alignment member extending in a first direction perpendicular to the first rod, placing the third rod through the second tube of the second alignment member extending in a second direction opposite and parallel to the first direction and perpendicular to the first rod, placing a ball in line collinear with a longitudinal axis of the second rod. aligning feet of a golfer to the third rod, and aligning a golf club with the ball by aligning a golfer's feet with the third rod to address the ball with feet aligned to the third rod.

In another embodiment, a swing alignment system includes a pair of tubes each configured to accommodate a rod therethrough, and a cross member connected between and separating the pair of tubes, the cross member adjustable in length to separate the pair of tubes by an adjustable difference. The pair of tubes extends parallel to one another, a first tube of the tubes extending in a first direction perpendicular to the cross member, and a second tube of the tubes extending in a second direction opposite and parallel to the first direction and perpendicular to the cross member. At least two rods fit through the tubes, a rod through each tube, the rods extending parallel to one another when in the tubes.

In another embodiment, a method of operating a swing alignment system as described above includes placing a first rod of the at least two rods through the first tube to extend in the first direction, placing a second rod of the at least two rods through the second tube to extend in the second direction, aligning a golfer's feet to the first rod, and adjusting the length of the cross member to place the second rod at a distance approximately a distance between the golfer's feet and a proper golf stance with a golf club aligned with the first rod.

In another embodiment, an alignment device for putting includes a bridge member having two uprights and a cross member. The uprights are spaced an adjustable distance apart by the cross member. The cross member has a number of through openings spaced along the cross member to accommodate the two uprights. Each upright includes an opening at a bottom thereof, the openings of each upright parallel to each other when assembled to the cross member. A pair of rods fit through the openings, the rods extending parallel to one another when in the openings.

In another embodiment, a swing alignment system includes at least two alignment members each configured with openings to accommodate at least two rods therethrough perpendicular to each other, and at least two rods that fit through the openings, a rod through each opening, the rods extending perpendicular to one another when in the tubes.

In another embodiment, a method of operating a swing system includes placing a first rod through a first pair of 180 degree spaced apart openings of a first alignment member and a first pair of 180 degree spaced apart openings of a second alignment member. A second rod is placed through a second pair of 180 degree spaced apart openings, 90 degrees apart from the first pair of openings, of the first alignment member extending in a first direction perpendicular to the first rod. A third rod is placed through a second pair of 180 degree spaced apart openings, 90 degrees apart from the first pair of openings, of the second alignment member extending in a second direction opposite and parallel to the first direction and perpendicular to the first rod. A ball is placed in line collinear with a longitudinal axis of the second rod. A golfer's feet are aligned to the third rod, and a golf club is aligned with the ball by aligning the golfer's feet with the third rod to address the ball with feet aligned to the third rod.

In another embodiment, an alignment device for putting includes two bridges, and at least two rods configured to extend through openings in the bridges to create a putting area bordered by the rods and the bridges. Each bridge includes a pair of base elements, a trestle that extends between the two base elements, a string support that extends from the trestle, and at least one target that is suspended from the trestle.

In another embodiment, an alignment device for putting includes two bridges, and at least two rods configured to extend through openings in the bridges to create a putting area bordered by the rods and the bridges. Each bridge includes a pair of base elements, a trestle that extends between the two base elements, a string support that extends from the trestle, and at least one target that is suspended from the trestle.

This summary is not intended to describe each disclosed embodiment or every implementation of the swing alignment systems, putting aid, or methods of using the same. Many other novel advantages, features, and relationships will become apparent as this description proceeds. The figures and the description that follow more particularly exemplify illustrative embodiments.

DETAILED DESCRIPTION

Embodiments of the present disclosure provide alignment aids for putting and for swing path. They may be used in combination, or alone.

Figure 1:
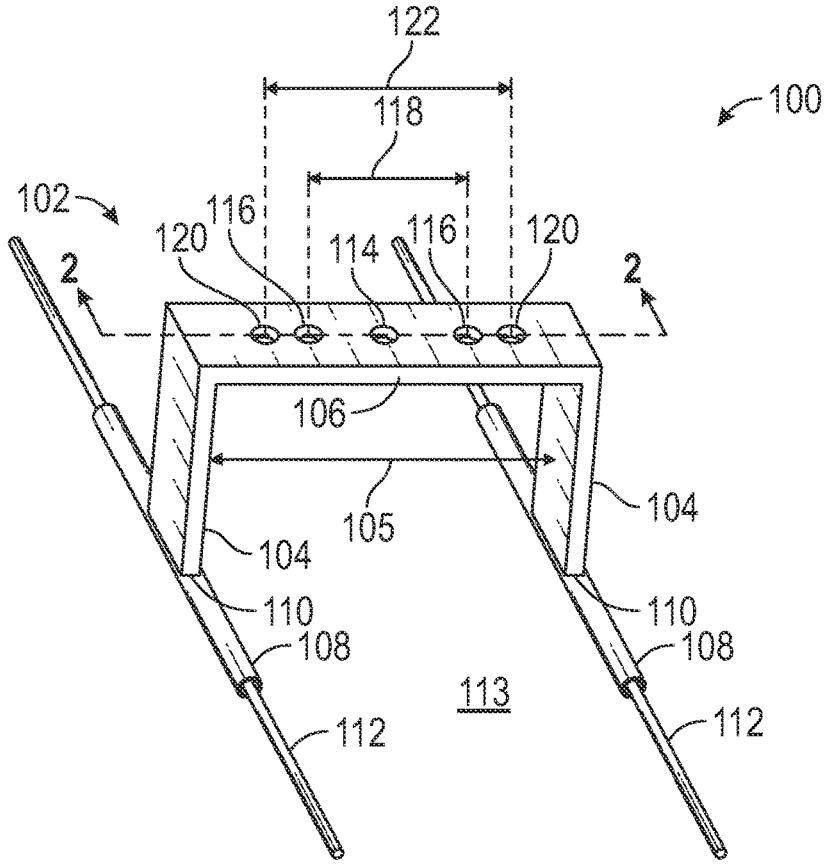
FIG. 1 is a perspective view of a putting aid according to an embodiment of the present disclosure.
Figure 2:
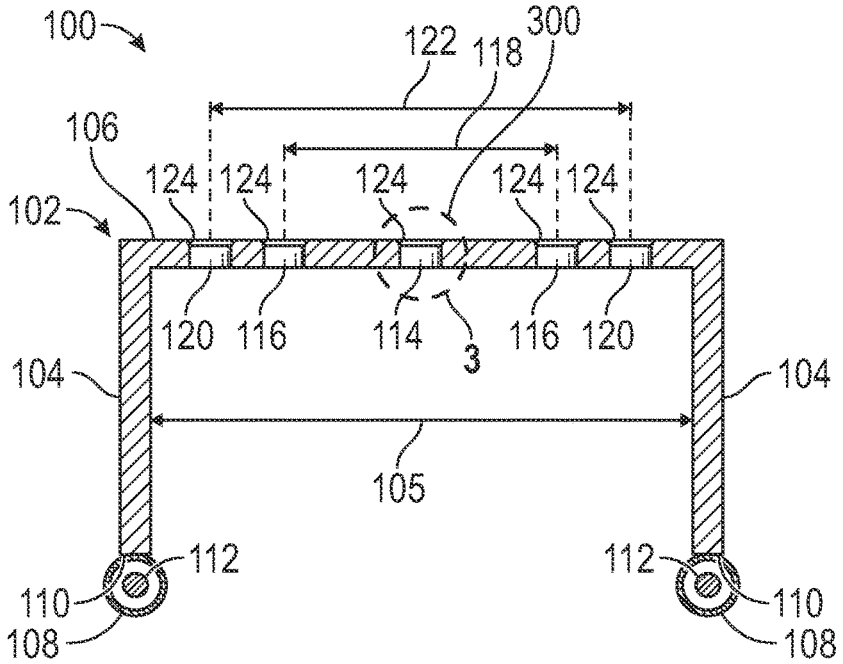
FIG. 2 is a sectional view of the putting aid of FIG. 1 taken along lines 2-2 thereof.

In one embodiment, a putting aid 100 is shown in perspective view in FIG. 1, and in front elevation view in FIG. 2. Putting aid 100 comprises, in one embodiment, a bridge member 102 having two uprights 104 and a cross member 106. Uprights 104 are a distance 105 apart. In one embodiment, the distance 105 is a specific width, such as two times a diameter of a standard golf hole, although the distance 105 is not required to be that width. Other widths could be used without departing from the scope of the disclosure. In one embodiment, the bridge member 102 is a unitary piece, that is, formed from a single piece of material, such as aluminum or the like. In another embodiment, the bridge member is formed of multiple pieces. The unitary or part construction of the bridge member does not affect is operation, and each are within the scope of the disclosure.

The bridge member 102 uprights 104 are each attached to a tube 108 aligned along the respective bottom 110 of the uprights 104. The tubes 108 are parallel to one another, and are open to allow the passage of rods 112 therethrough to create a putting lane 113 bounded by the rods 112 and the tubes 108, over which the bridge member 102 rests. While rods are described, it should be understood that any member that can extend through openings is sufficient, and that the rods need not be round, but may be flat, with corresponding sheaths, without departing from the scope of the disclosure.

Bridge member 102 has a series of openings extending widthwise across the cross member 106 between the uprights 104. The openings include a center opening 114 that is centered in the middle of the bridge member halfway between the uprights 104. Additional openings are provided in pairs equidistant from the center opening 114. As shown, bridge member 102 includes first pair of openings 116 and second pair of openings 120. First pair 116 are a distance 118 apart. Second pair 120 are a distance 122 apart. The distances 118 and 122 are in one embodiment specific widths, although they need not be. In one embodiment, width 122 is the diameter of a standard golf hole, and width 118 is the diameter of a standard golf ball or slightly larger than the diameter of a standard golf ball. While openings 116 and 120 are shown, it should be understood that additional openings may be provided, and that such other openings, or the openings 116 and 120, may be spaced apart differently, such as at different widths and locations, without departing from the scope of the disclosure.

Figure 3:
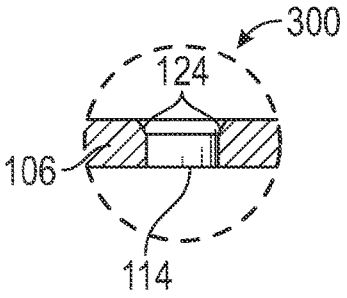
FIG. 3 is a close-up view of the are 300 called out in FIG. 2.

Openings are in one embodiment sized to accommodate a golf tee, with the opening of sufficient width to accommodate the tee stem but narrow enough to hold the tee by the tee head without falling through the opening. Further, the openings are beveled or countersunk with top edge bevels/countersinks 124 to allow for a rocking motion of a tee placed in the opening. The countersink 124 for one hole 114 is shown further in the close-up 300 of FIG. 3.

Figure 4A:
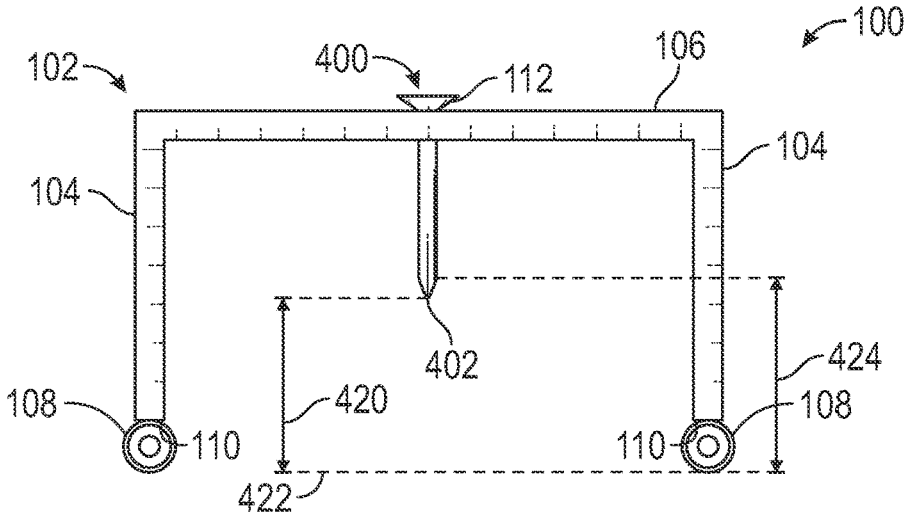
FIG. 4A is a front elevation view of the putting aid of FIG. 1. with a tee for putting alignment.
Figure 4B:
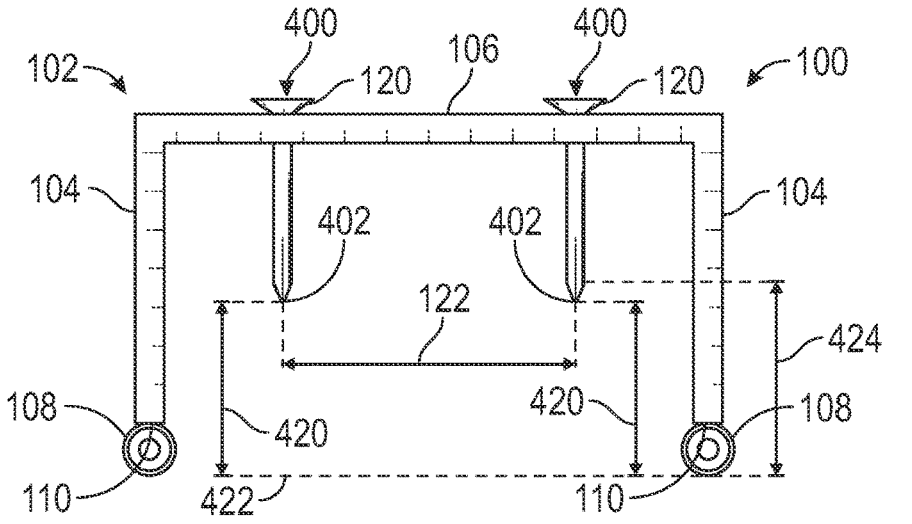
FIG. 4B is a front elevation view of the putting aid of FIG. 1 with a pair of tees for putting alignment.

A tee placed in the openings 114, 116, 120 forms a movable obstacle in the opening under the bridge member and between the tubes 106. FIGS. 4A and 4B are elevation views a putting aid 100 with tees 400 placed in various openings of the putting aid 100. FIG. 4A shows a tee 400 placed in center opening 114. In one embodiment, the tee bottom 402 drops to a point in height 420 above the ground level 422 that is smaller than a diameter of a golf ball, indicated by height 424. Therefore, when a golf ball passes through the putting bridge 102, and is at or near the center thereof as indicated by the tee 402 in FIG. 4A, the tee will be hit and deflect.

Referring now to FIG. 4B, two tees 400 are placed in openings 120 of putting bridge 102. In one embodiment, the lateral distance 122 between the bottoms 402 of the tees 420 is equivalent to the diameter of a standard golf hole, although this need not be the case. The tees 400 have bottoms 402 that drop to the height 420 above ground level 422, which in one embodiment is lower than height 424 which is equal to the diameter of a golf ball. Therefore, when a golf ball is putted through the putting bridge 102, it can be seen by the person putting whether the golf ball hits the tees, or whether the golf ball goes between the tees without hitting them. In this usage, putting accuracy may be determined. For example, when a golf ball hits a tee placed in one of the openings, the tee deflects so that the putter can see the deflection, and determine the location of the putt. When tees are placed in openings such as openings 116, spaced for example at the width of a hole, if the putted golf ball goes between the tees, or deflects one of the tees, accuracy of the putt may be determined.

Figure 5:
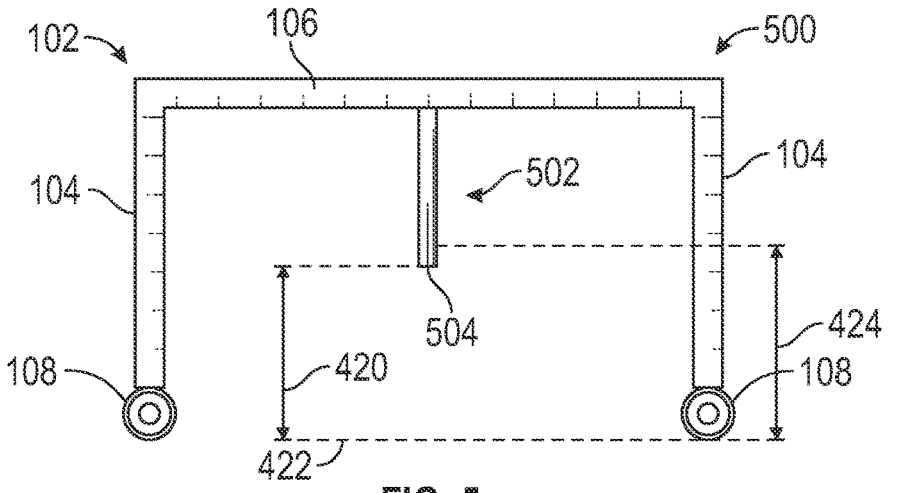
FIG. 5 is a front elevation view of the putting aid of FIG. 1 with a deflection strip for putting alignment.

Referring to FIG. 5, a putting aid 500 is shown in side elevation. Putting aid 500 is similar to putting aid 100, but instead of having openings for tees 402, a flexible deflectable member 502 is used. This is a material of sufficient stiffness to maintain a straight bearing when attached to the cross member 106, but is capable of being deflected without changing the trajectory of a golf ball. Suitable materials may include thin plastic strips, or the like. The bottom 504 of member 502 is at a height 420 above ground level 422, and below a height 424 of a golf ball in one embodiment. While not shown, additional flexible deflectable members 502 may be placed on cross member 106 in positions similar or identical to openings 116 and 120 as discussed above, or in other openings also as discussed above.

Figure 6:
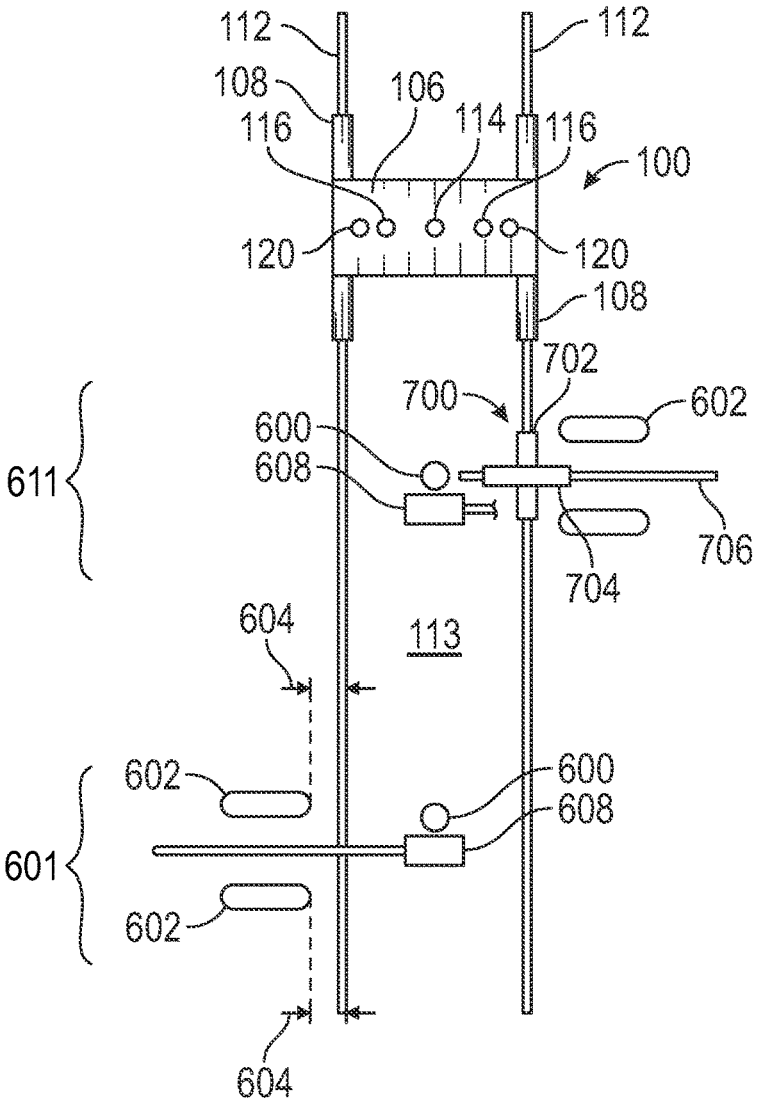
FIG. 6 is a top view of the putting aid of FIG. 1 in use, showing a putter and golf ball.

Referring now to FIG. 6, operation and use of the putting aid 100 is described. A golfer places the rods 112 through tubes 108 of the putting aid 100. The rods 112 are, when placed into the tubes 108, parallel to each other, and form the putting lane 113. As generally indicated at 601, a golf ball 600 is placed in the lane 113, in one embodiment near an end of the rods 112 away from the putting aid 100. The putter aligns his or her feet 602 with the rod 112 closest to their stance, to assure that the stance is properly aligned by placing the feet 602 at the same distance 604 from the rod 112. A putter 608 is then aligned properly when the ball 600 is addressed, and putting accuracy may be improved. The ball 600 is putted, and depending on the placement of tees 400 in the openings, or the flexible deflectable member 502, accuracy of the putt may be determined.

Figure 7:
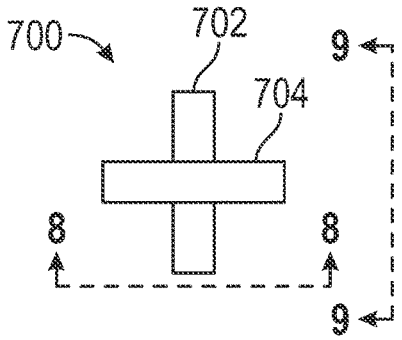
FIG. 7 is a top view of a cross alignment element according to an embodiment of the present disclosure.
Figure 8:
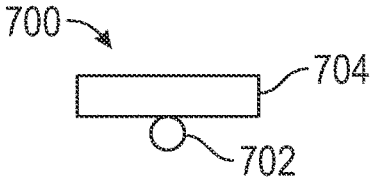
FIG. 8 is a view of the cross alignment element of FIG. 7 taken along lines 8-8 thereof.
Figure 9:
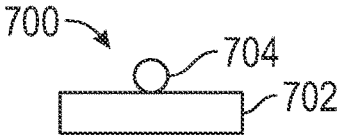
FIG. 9 is a view of the cross alignment element of FIG. 7 taken along lines 9-9 thereof.

FIGS. 7-9 illustrate an alignment member 700 which may be used in conjunction with the putting aid 100, 500, or with additional aids described below. Alignment member 700 comprises in one embodiment a pair of tubes 702 and 704 that are attached to one another perpendicularly, that is, tube 702 and tube 708 have perpendicular longitudinal axes. Referring back to FIG. 6, as generally indicated at 611, tube 704 of alignment member 700 is slid onto a rod 112 and a rod 706 is slid through tube 704. Rod 706 is thus perpendicular to rod 112, and provides a center of a stance between feet 602 of a person putting. The rod 706 is aligned with ball 600 by sliding the alignment member 700 to where the ball is, or by moving the ball to where the rod 706 is. Then, putting such as described above is performed.

Figure 10:
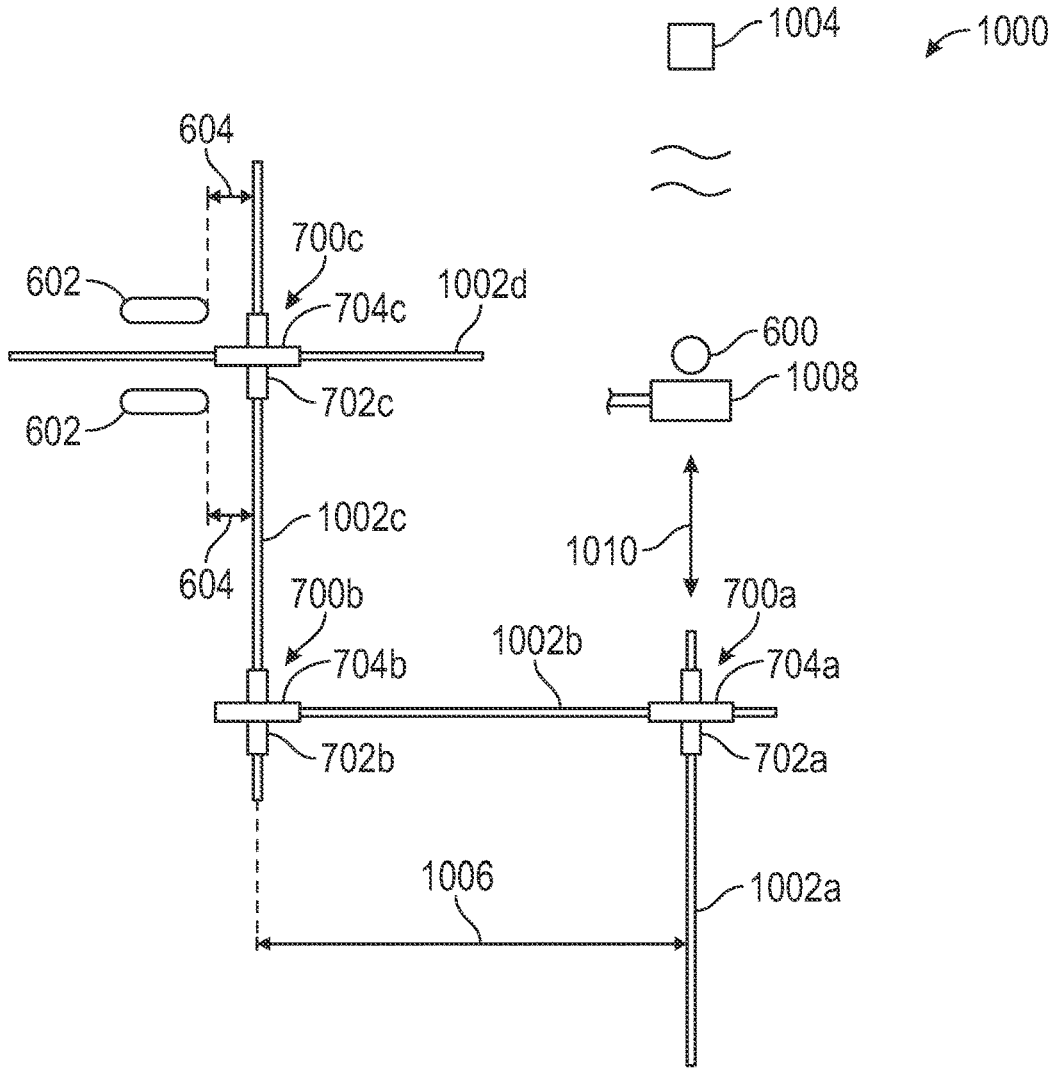
FIG. 10 is a top view of a cross alignment system using rods and cross alignment elements of FIG. 7.

FIG. 10 is a top view of a use embodiment of a swing system 1000 using the alignment member 700 and rods 1002 for swing path alignment. Rods 1002, 112, 706, and the like may be made of any number of materials, including but not limited to plastic, fiberglass, metal, or the like. In FIG. 10, a golf ball 600 is aligned with rod 1002*a*, which is placed through tube 702*a* of an alignment member 700*a* and a target 1005. Rod 1002*a* is aligned to point along its longitudinal axis toward the target 1004 through ball 600. Target 1004 may be a few feet or hundreds of yards distant from the system 1000. Rod 1002*b* is placed through tube 704*a* of alignment member 700*a* at one end and through tube 704*b* of alignment member 700*b* at its other end. Rod 1002*c* is placed through tube 702*b* at one end and through tube 702*b* of alignment member 700*c* at its other end. This places rods 1002*a* and 1002*c* parallel to each other and a distance 1006 apart. This distance 1006 may be adjusted by positioning alignment members 700*a* and 700*b* closer together along rod 1002*b*.

Optionally, in order to align a stance (shown as feet 602 an equal distance 604 from rod 1002*c*), a rod 1002*d* is placed through tube 704*c* of alignment member 700*c*, and also aligned to the ball 600. Then, a golf club 1008 may be used to address the ball 600, with proper foot alignment as shown at 602 and 604, and with the swing path of the club 1008 indicated along arrow 1010, which is aligned with rod 1002*a*, the head of club 1008, ball 600, and target 1004. If a different target is desired, the rod 1002 is aligned with the different target. In so doing, the rods 1002*b*, 1002*c* (and 1002*d* if being used) will move with rod 1002*a* to keep rod 1002*c* parallel to rod 1002*a*, and rod 1002*b* (and optionally rod 1002*d*) perpendicular to rods 1002*a* and 1002*c* and parallel to each other.

Figure 11:
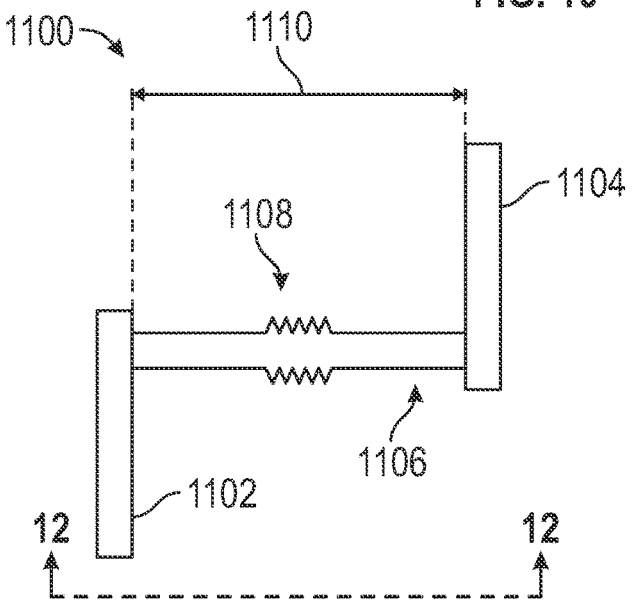
FIG. 11 is a top view of an adjustable alignment element according to another embodiment of the present disclosure.
Figure 12:
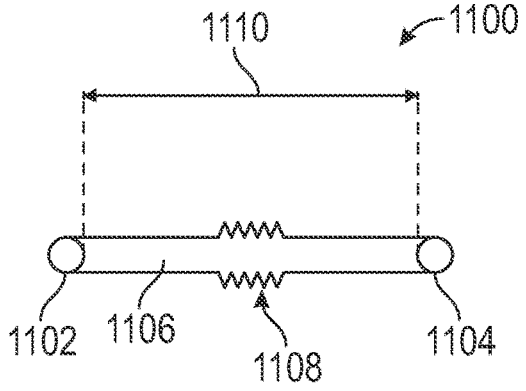
FIG. 12 is a side view of the adjustable alignment element of FIG. 11 taken along lines 12-12 thereof.

FIG. 11 is a top view of another alignment device 1100. FIG. 12 is a view of the alignment device 1100 of FIG. 11 taken along lines 12-12 thereof. Alignment device 1100 comprises in one embodiment a pair of rod tubes 1102 and 1104 separated by a cross member 1106. A length 1110 of cross member 1106 is adjustable via an adjustment device 1108. Adjustment device may comprise any number of adjustable configurations, including by way of example only and not by way of limitation, telescoping tubes or rods (with or without a protruding knob on one tube and detents on another), nesting tubes, friction fit tubes, threaded tubes, and the like. The type of adjustment mechanism may be changed without departing from the scope of the disclosure. It should also be understood that alignment member 1100 may be used "upside sown" to reverse the elongated ends of tubes 1102 and 1104 (see also FIG. 13).

Figure 13:
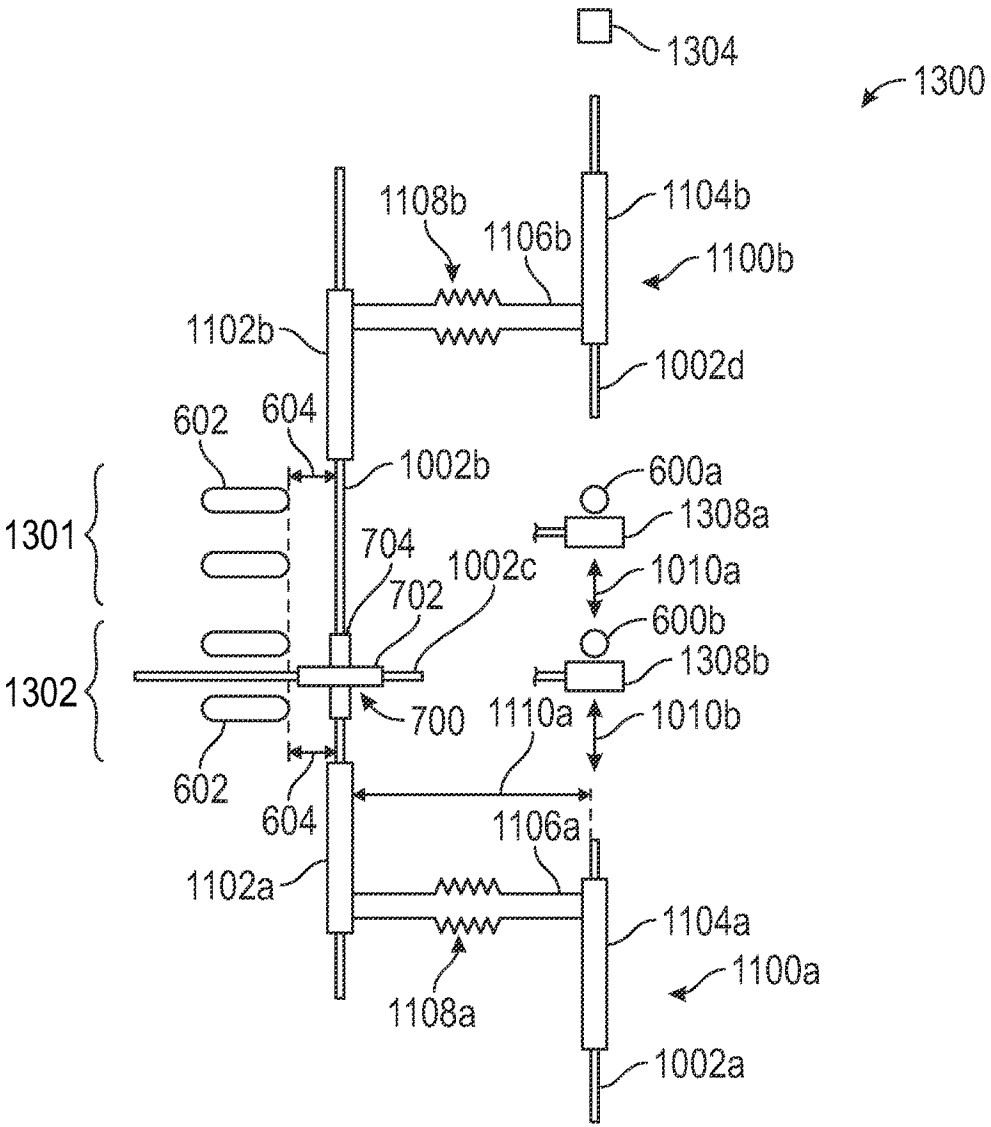
FIG. 13 is a top view of adjustable alignment elements such as shown in FIG. 11 in use with rods for an embodiment of the present disclosure.

FIG. 13 is a top view of a use embodiment of a swing system 1300 similar to that of FIG. 10, but using alignment members 1100 and rods 1002 for swing path alignment. As in FIG. 10, in FIG. 13, a golf ball 600*a* is aligned with rod 1002*a*, which is placed through tube 1104*a* of an alignment member 1100*a*, and a target 1304. Rod 1002*a* is aligned to point along its longitudinal axis toward the target 1304 through ball 600*a*. Target 1304 may be a few feet or hundreds of yards distant from the system 1300. Rod 1002*b* is placed through tube 1102*a* of alignment member 1100*a* at one end. The distance 1110*a* may be adjusted by adjusting the adjustment device 1108*a*.

Alternatively, in order to align a stance (shown as feet 602 an equal distance 604 from rod 1002*b* at 1302), an alignment device 700 may be used with the rod 1002*b* through tube 704 and a rod 1002*c* through tube 702 to align club 1308*b* with ball 600*b*, just like in FIG. 10.

Optionally, another alignment device 1100*b* may be used at the other end of the swing path of club 1308*a* or 1308*b*, using another rod 1002*d* through tube 1104*b* and rod 1002*b* through tube 1102*b*. With this use, distances 1110*a* and 1110*b* are made equal, and rods 1002*a* and 1002*b* are parallel and collinear.

Figure 14:
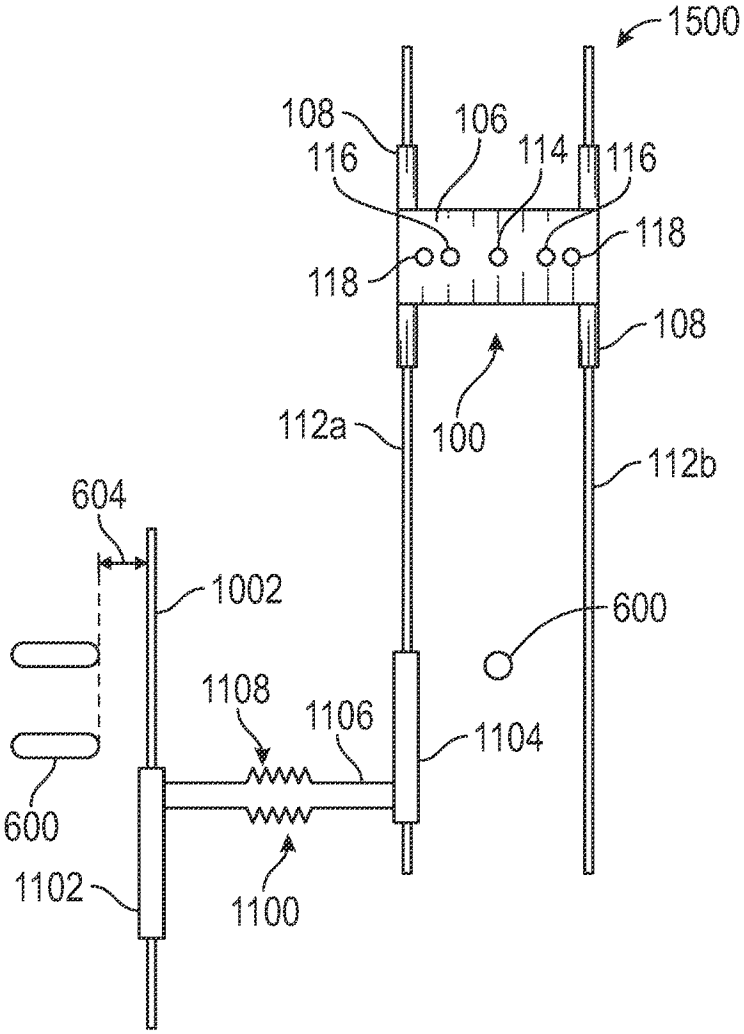
FIG. 14 is a top view of an adjustable alignment element such as that of FIG. 11 with rods and a putting aid such as that shown in FIG. 1 in use according to an embodiment of the present disclosure.

FIG. 14 shows use of an alignment device 1100 with a putting aid 100 using three rods, rod 112*a* through one of tubes 108 of the putting aid 100 and through tube 1104 of the alignment device 1100, rod 112*b* through the other tube 108 of the putting aid 100, and rod 1002 through the tube 1102 of the alignment device 1100. With this arrangement, rods 112*a*, 112*b*, and 1002 are all parallel to each other, and ball 600 may be putted as described above with respect to FIGS. 1-6.

Figure 15A:
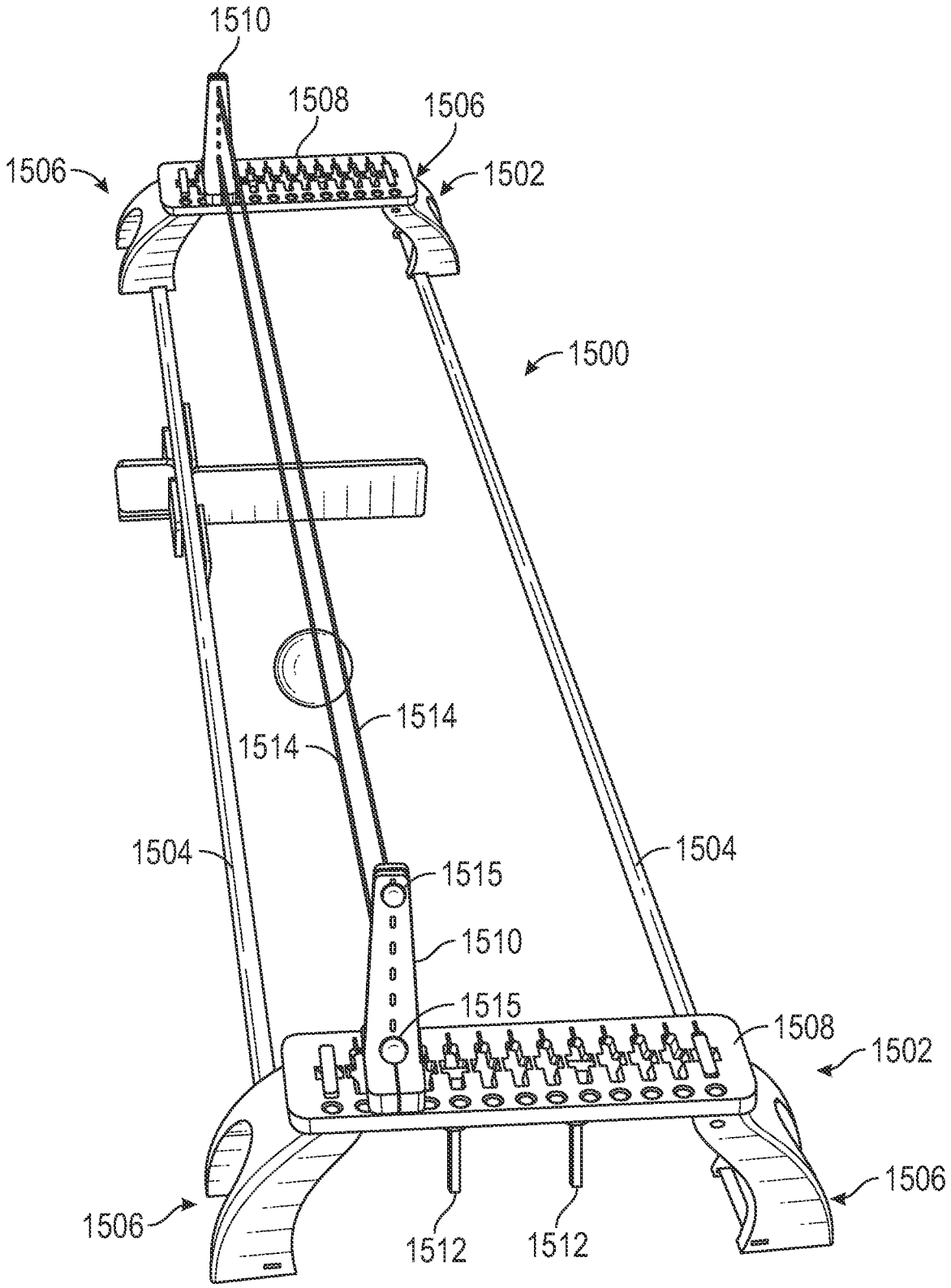
FIG. 15A is a perspective view of a putting aid according to another embodiment of the present disclosure.

Another embodiment of an alignment device 1500 for putting is shown in perspective view in FIG. 15A. Alignment device 1500 includes a bridge 1502 and rods 1504. In some embodiments, a pair of bridges 1502 are used, as shown in FIG. 15A. A bridge 1502 includes in one embodiment a pair of base elements 1506, a trestle 1508, a string support 1510, and at least one target 1512. In FIG. 15A, a pair of bridges 1502 are separated and aligned using rods 1504. Rods 1504 may be flat so that they do not roll easily, but need not be. The rods 1504 extend in one embodiment through openings in the base elements 1504 (see further detail later herein). String supports 1510, one on each of the two bridges 1502 in FIG. 15A, is used to stretch a string or strings 1514 between the two bridges 1502. The string or strings 1514 are used to identify a ball path for a putt. When two strings 1514 are used at different height son the string support 1510, they are aligned so that a top down look can be assured of being proper. Each trestle 1508 has a number of openings (described further below) into which its string support 1510 may be mounted. A straight line is made between two string supports 1510 by string or strings 1514. When the string supports 1510 are in a same trestle opening, the line is parallel to the rods 1504. When the string supports 1510 are in different trestle openings, the line is still straight, but is not parallel to the rods 1504. This may be done, for example, to address a putt with break, or the like.

String supports 1510 are also used to visually sight down onto a putting line. When multiple strings 1514 are used for alignment, when viewed from above, it assures a user that the user is sighting directly down to the proper location as the strings 1514 are parallel when properly strung into the string supports 1510. This allows for better alignment of all putts, and the proper perspective on a golf ball that is to be putted.

Figure 15B:
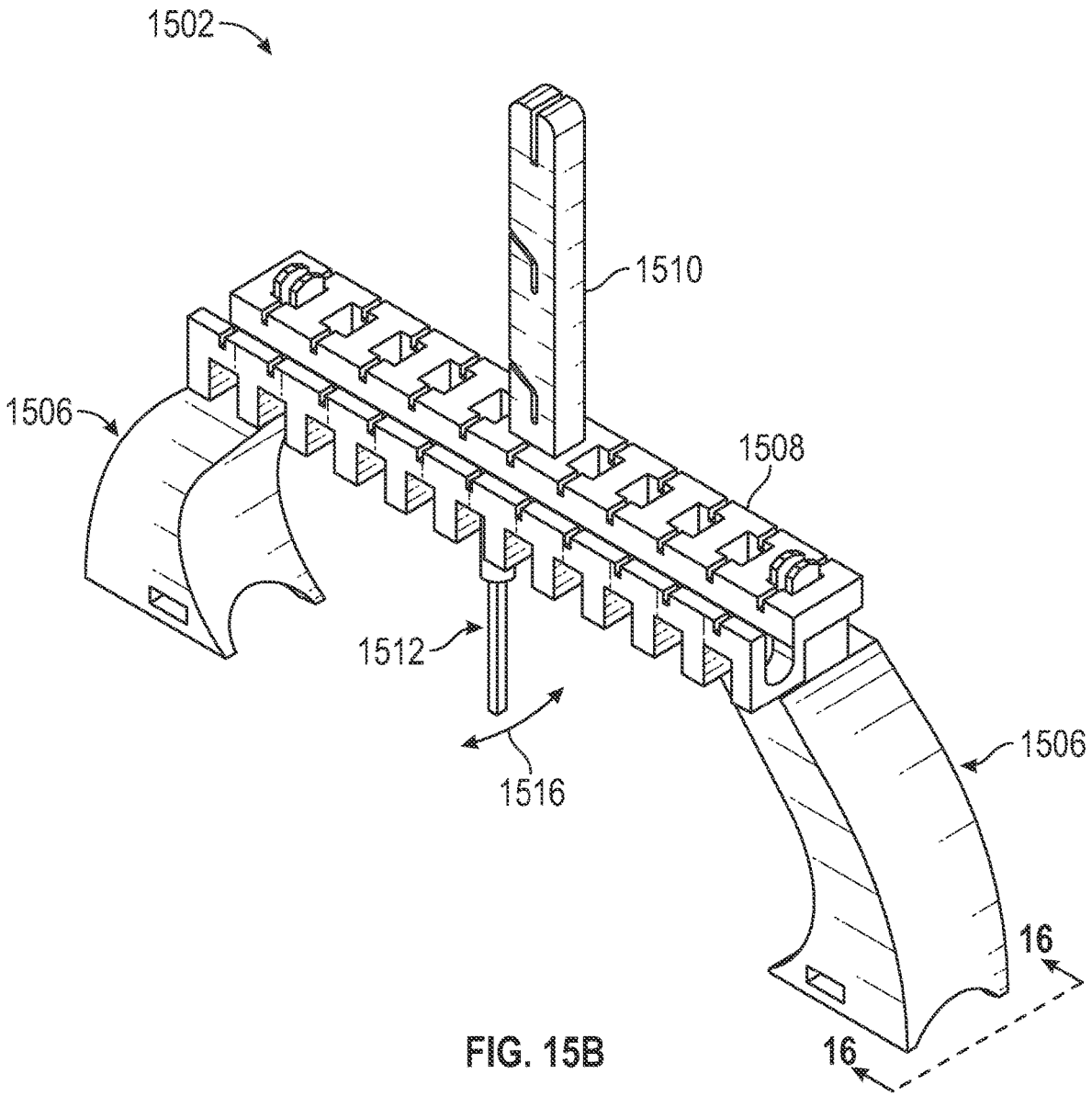
FIG. 15B is a perspective view of a bridge of the embodiment of FIG. 15A.
Figure 16:
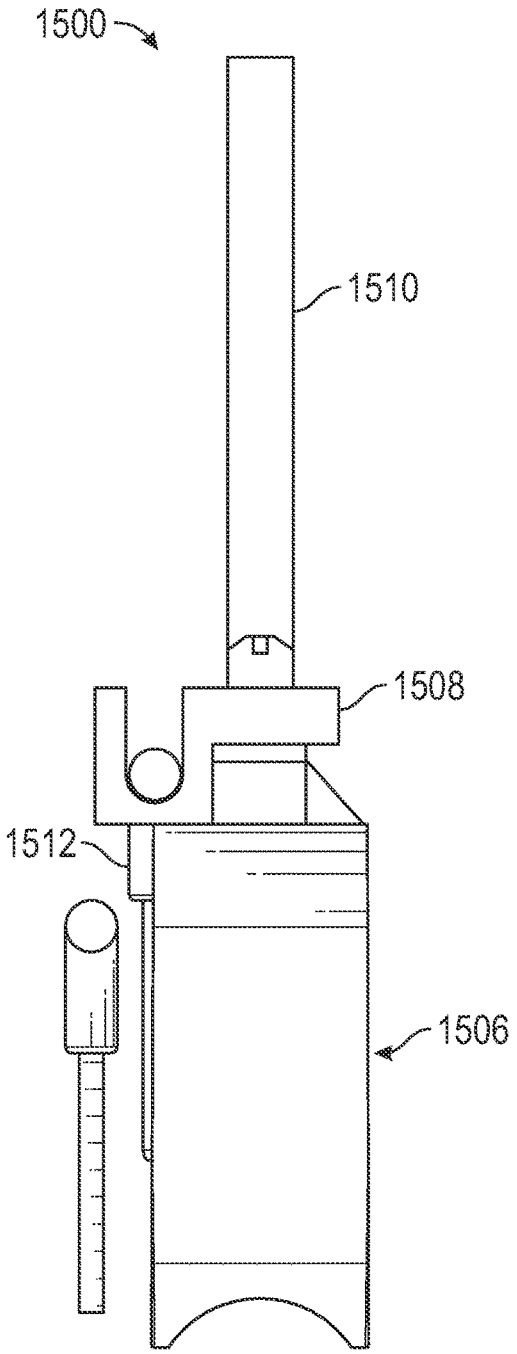
FIG. 16 is an end elevation view of the bridge of FIG. 15B.

A single bridge 1502 is shown in a perspective view in FIG. 15B and in a side view taken along lines 16-16 of FIG. 15B in FIG. 16. Base elements 1506 are separated and support trestle 1508 with a top extension of the bridge element 1506 fitting into one of the openings in the trestle 1508. String support 1510 also fits into an opening in the trestle 1508 with a bottom extension. The at least one target 1512 fits into an opening of other openings in the trestle 1508. The target 1512 or targets may be placed in any opening of the other openings of the trestle 1508. The base elements 1506 may support the trestle 1508 through any pair of the openings in the trestle to adjust the distance between the base elements 1506. Details of each of the separate components is provided further below. A single target 1512 may be used as an aiming point for a putt. A pair of targets may be spaced apart in openings of the other openings to be used as a representation of a hole or the like, with an aiming point between the targets 1512.

Figure 17:
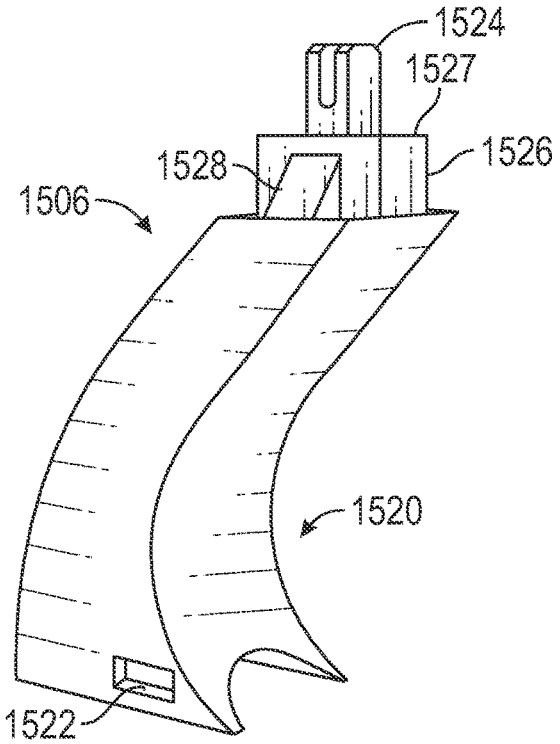
FIG. 17 is a perspective view of a base element of the bridge of FIG. 15B.
Figure 18:
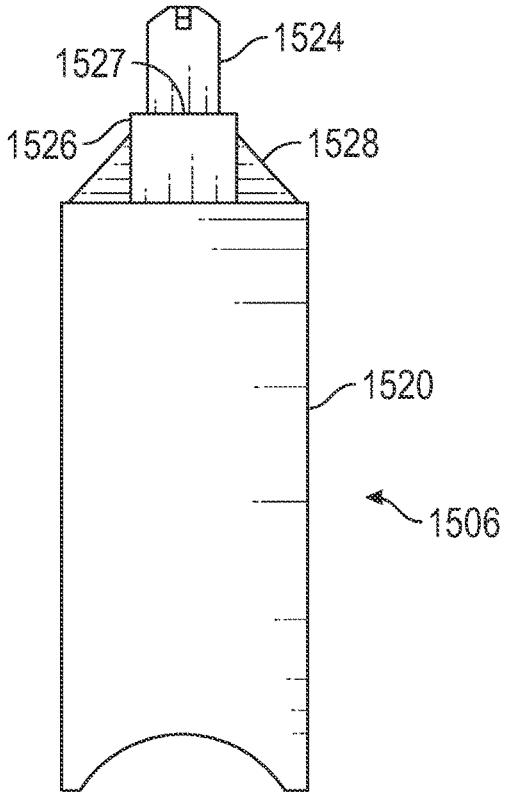
FIG. 18 is an end elevation view of the base element of FIG. 17.
Figure 19:
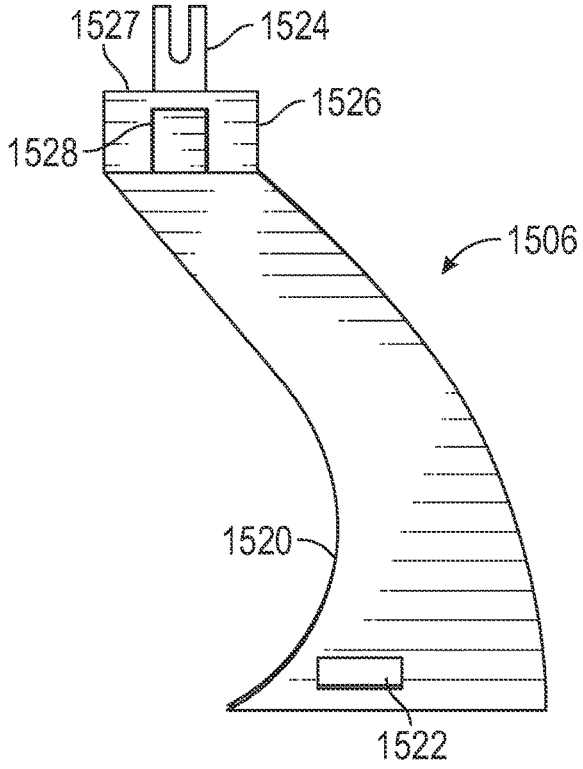
FIG. 19 is a side elevation view of the base element of FIG. 17.
Figure 20A:
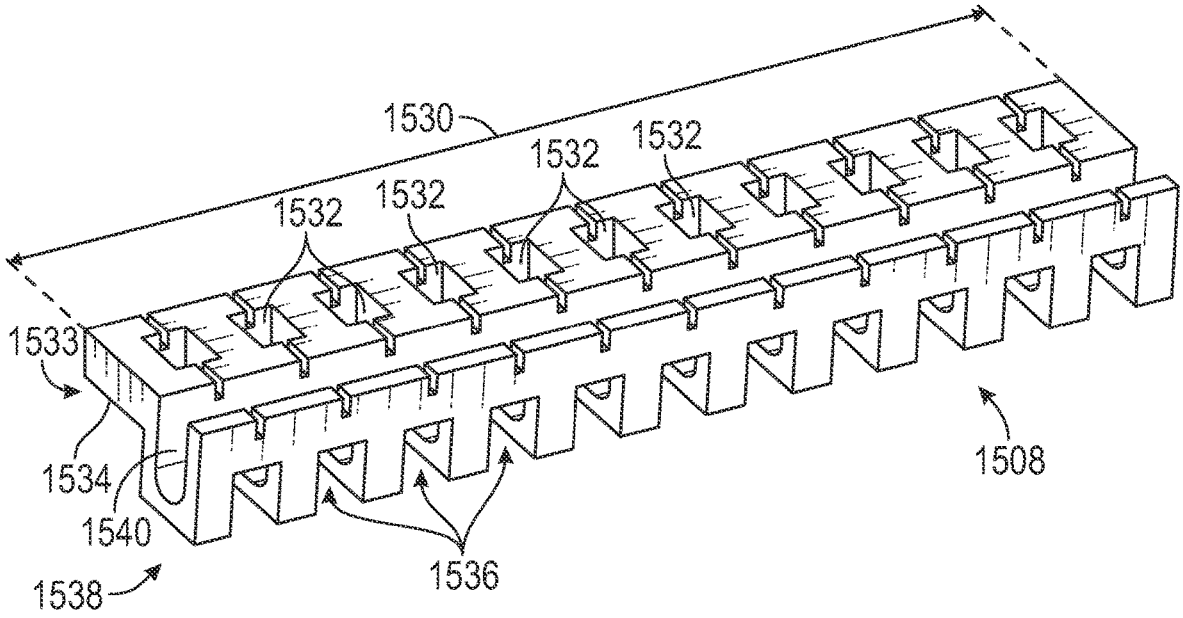
FIG. 20A is a perspective view of a trestle of the bridge of FIG. 15B.
Figure 20B:
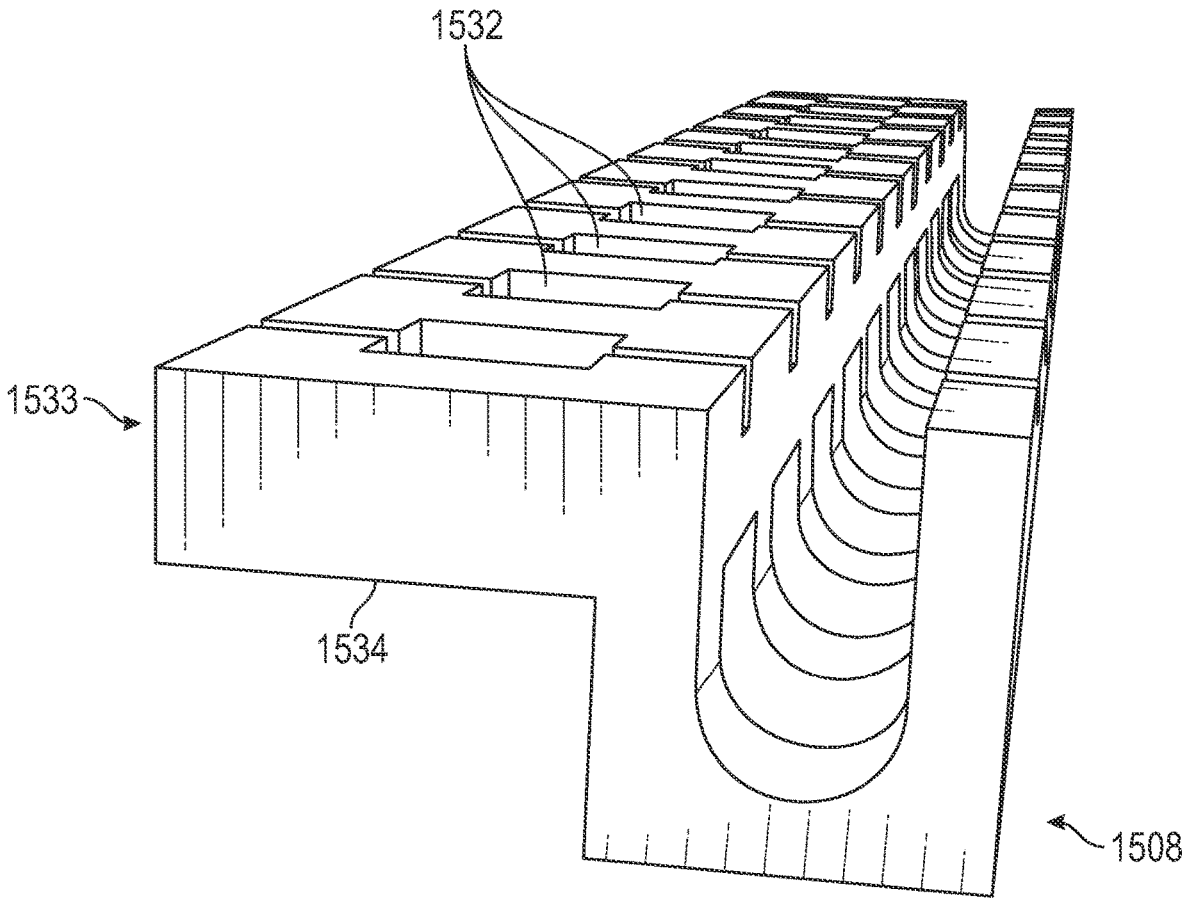
FIG. 20B is a second rotated perspective view of the trestle of FIG. 20A.
Figure 21:
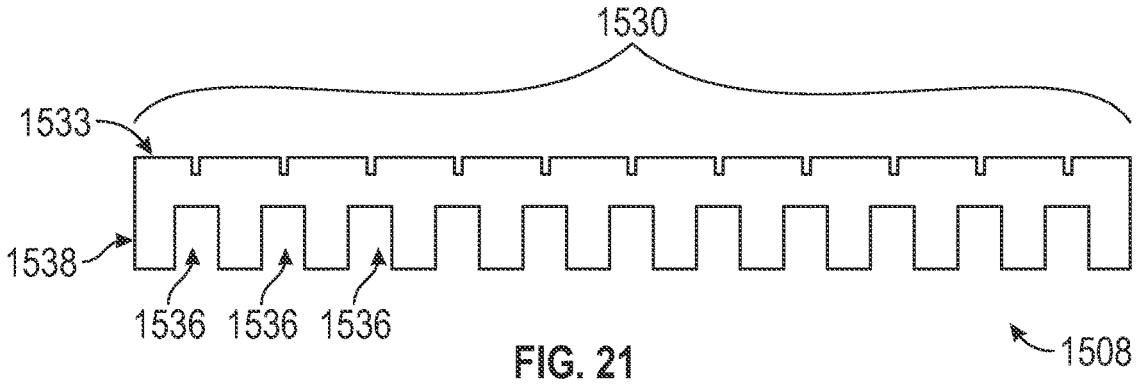
FIG. 21 is a front elevation view of the trestle of FIG. 20A.
Figure 22:
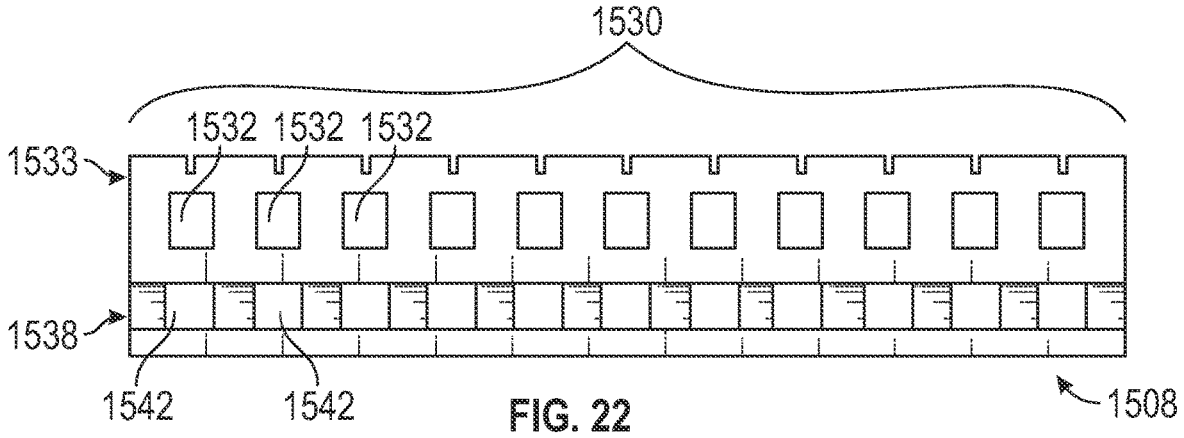
FIG. 22 is a top view of the trestle of FIG. 20A.

FIGS. 17-19 illustrate one embodiment of a base element 1506 in perspective, side elevation, and front elevation views, respectively. Base element 1506 comprises a body 1520 that has in one embodiment a curved section leading from a ground contact area and supporting a top portion having a trestle engaging protrusion 1524 and trestle supports 1526 and 1528. Trestle support 1526 has a top surface 1527. Trestle support 1528 comprises a pair of wedge shaped elements. As seen in FIGS. 17 and 19, openings 1522 configured to accept flat rods such as rods 1504 are positioned near a bottom of the body 1520. The openings in the bridge base elements are shaped to accommodate flat rods as are shown in FIG. 15A, It should be understood that the rods need not be flat, and that a cross section of the rods, as well as a shape of the openings, may be altered without departing from the scope of the disclosure.

FIGS. 20A-B and 21-22 illustrate one embodiment of a trestle 1508 in perspective, side perspective, front elevation, and top elevation views, respectively. Trestle 1508 has a length 1530. The length 1530 may be shorter or longer without departing from the scope of the disclosure. Trestle 1508 has a first plurality of openings 1532 in an upper support portion 1533, an opening 1532 of the plurality of openings 1532 sized to accommodate protrusion 1524 of a base element 1506. With two base elements 1506, each of which has its protrusion 1524 extending into a respective opening 1532 of the plurality of openings 1532, the trestle 1508 is supported by the base elements 1506. Lower edge 1534 of upper support portion 1533 rests on a top 1527 of trestle support 1526. Further slot-type openings 1536 extend from front to back of a target support portion 1538. A target trough 1540 extends lengthwise across the target support portion 1538. The target trough 1540 has openings 1542 therein to accommodate a portion of a target 1512. The openings 1536 allow a target 1512 that is placed into the target trough to swing in the direction of arrow 1516 when contacted by a golf ball, for example (see FIG. 15B).

Figure 23:
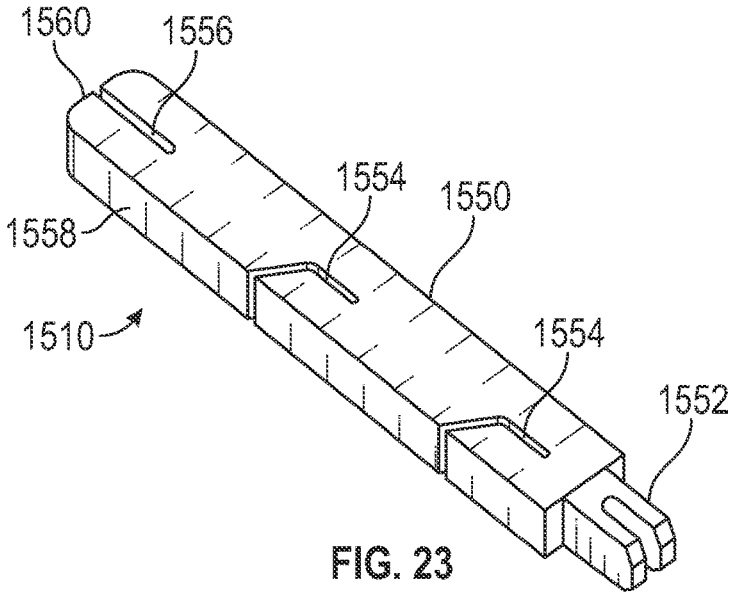
FIG. 23 is a perspective view of a string support of the bridge of FIG. 15A.
Figure 24:
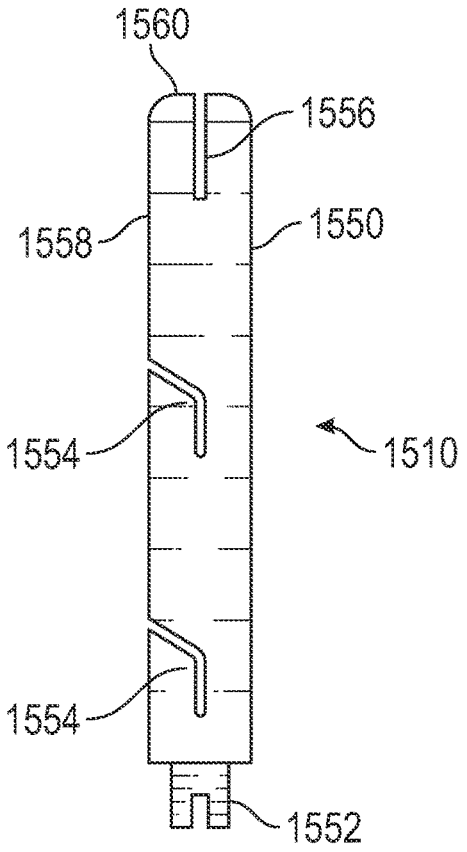
FIG. 24 is a front elevation view of the string support of FIG. 23.

FIGS. 23-24 illustrate one embodiment of a string support 1510 in perspective and side elevation views, respectively. String support 1510 in one embodiment comprises a main body 1550 and a mounting element 1552 for mounting to a trestle 1508. The main body 1550 has a plurality of string slots or openings 1554 with openings to a side of the main body 1550, and a string slot or opening 1556 at a top of the string support 1510. When a string support 1510 is to be mounted to a trestle 1508, the mounting element 1552 is inserted into an opening 1532 of the plurality of openings in the upper support portion 1533 of the trestle 1508. In one such mounting position, the string openings are aligned so that the slot 1556 is parallel to a putting path for a ball. That is, when a pair of bridges 1506 are aligned with rods 1504 aligning them, the slot 1556 extends through the main body 1550 parallel to the rods 1504. This is shown in greater detail in FIGS. 15A and 15B.

In order to provide a string path as described above, a string 1514 (see FIG. 15A) with a string stopper 1515 is slid into a slot, e.g., slot 1556, with the string stopper 1515 on an opposite side of the string support 1510 as the string strung between the two string supports 1510. An additional string 1514 may be strung using one of the slots 1554. Slots 1554 enter the main body 1550 at an angle, extend to a center line of the string support 1510, and then extend downward, making their interior slot portion parallel with the slot 1556. In this way, strings 1514 strung between two slots 1556 and between two slots 1554 are coplanar and parallel. This may be used to prepare proper sight lines for aligning a putt.

It should be understood that multiple string supports 1510 may be used on each trestle 1508, to allow for multiple possible swing paths. It should also be understood that the string supports 1510 on a pair of connected bridges 1506 need not be mounted at the same lateral position, but may be at different lateral positions.

Figure 25:
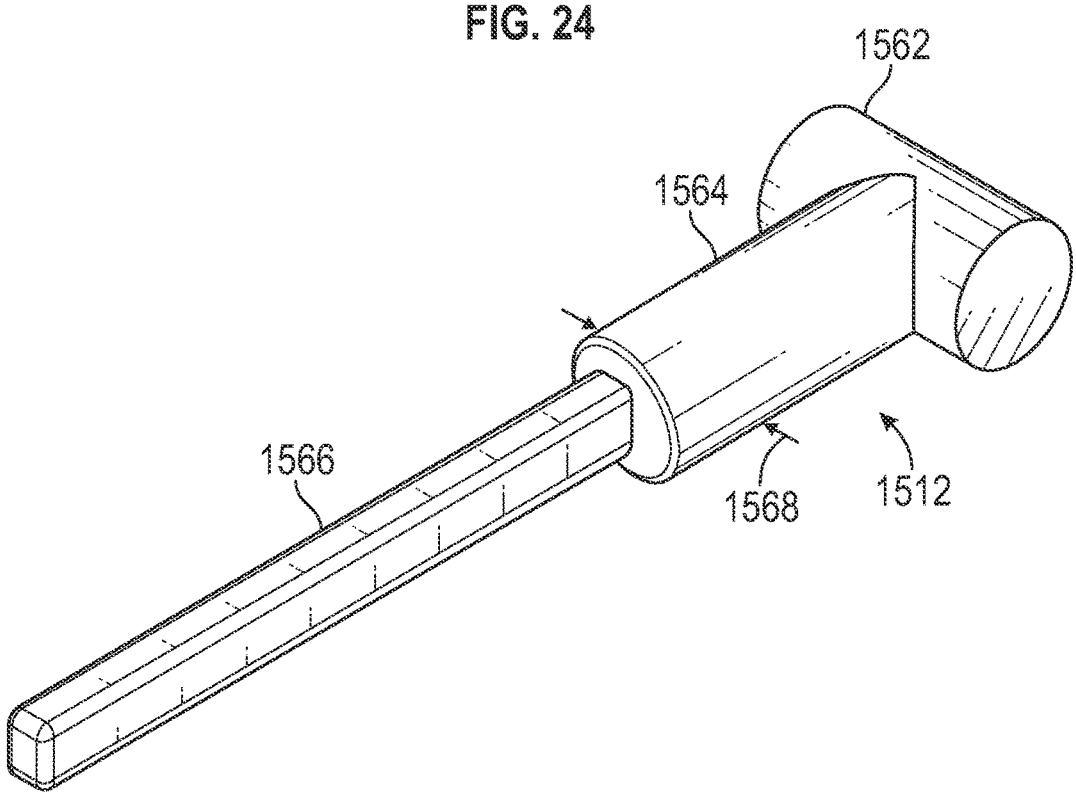
FIG. 25 is a perspective view of a target of the bridge of FIG. 15A.

FIG. 25 illustrates a target 1512 in perspective view. Target 1512 is mountable in the trough 1540 of trestle 1508 in one of the openings 1542 thereof. The rounded trough 1540 allows a suspending head 1562 of target 1512 to support the target 1512 when target spike 1566 and alignment body 1564 are inserted into an opening 1542 of the trough 1540. The alignment body 1564 in one embodiment has a diameter 1568 that is slightly smaller than a lateral width of openings 1542 in the trough 1540. The diameter 1568 being slightly smaller than the lateral width of the openings 1542 means that the target 1512 may be displaced in the direction of arrow 1516 but not laterally when struck by, for example, a golf ball. The curved edges of suspending head 1562 match that of a bottom of the trough 1540 so that when struck by a golf ball, the target 1512 can rock in the direction of arrow 1516. Target(s) 1512 provide immediate feedback on a ball strike without affecting the ball and its motion. In one embodiment, a marking or the like is placed on a top of the suspending head so that motion of the target may be easily detected.

In operation, an alignment device 1500 is assembled with bridges 1502, each bridge comprising a pair of base elements 1506, a trestle 1508, a target or targets 1512, and, optionally, a string support 1510. Rods 1504 are inserted into openings 1522 in the base elements 1506 to make a putting practice area.

Figure 26:
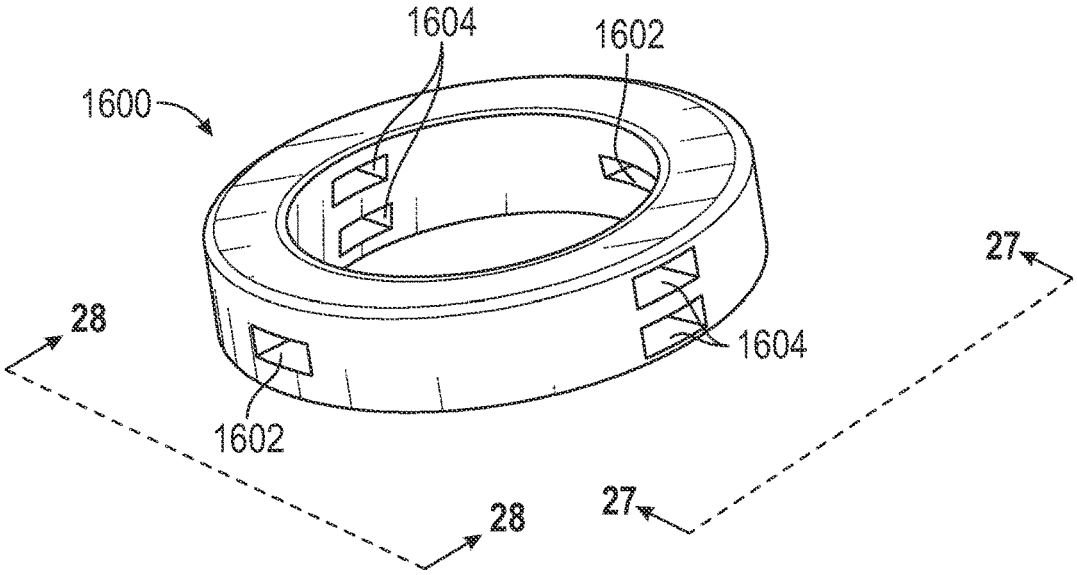
FIG. 26 is a perspective view of a connection ring used in embodiments of the present disclosure.
Figure 27:
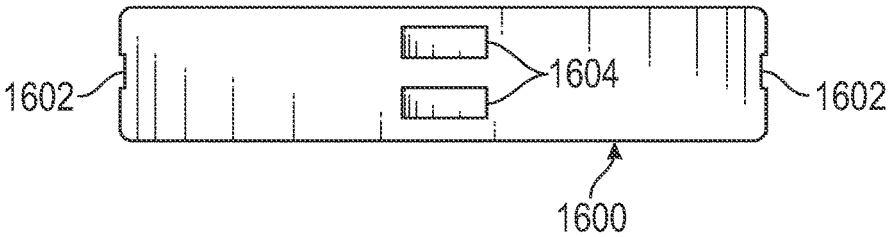
FIG. 27 is a view of the connection ring of FIG. 26 taken along lines 27-27 thereof.
Figure 28:
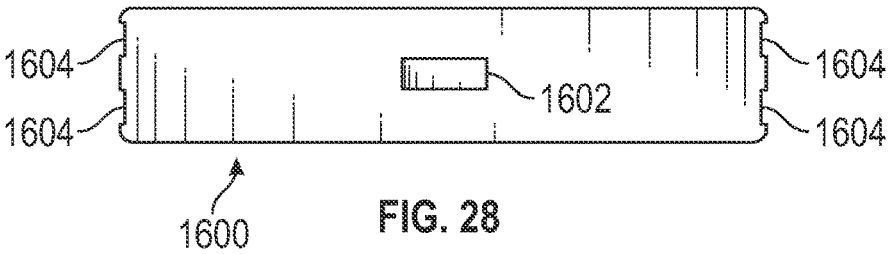
FIG. 28 is a view of the connection ring of FIG. 26 taken along lines 28-28 thereof.

In the embodiments described above with respect to FIGS. 6-14, alignment devices 700 are used for creating right angles and parallel rods. In the embodiments thereof, and in the embodiments shown in FIGS. 15A-25, alignment rings 1600, such as are shown in FIGS. 26-29, may be used for the same purpose. Referring to FIGS. 26-28, a ring 1600 is shown in perspective view, and in elevation views taken along lines 27-27 and 28-28, respectively. Ring 1600 is a toroidal shape, having a pair of openings 1602 on opposite sides of the ring 1600, spaced 180 degrees apart. The openings 1602 are shaped to accommodate flat rods such as rods 1504 shown in FIG. 15A. The ring 1600 also has a pair of double openings 1604 on opposite sides of the ring, at 90 degrees offset from the openings 1602, and 180 degrees apart from each other. The openings 1604 are also shaped to accommodate flat rods such as rods 1504 shown in FIG. 15A. The single openings 1602 and/or double openings 1604 may be used to assemble configurations for swing and putting practice using the embodiments of the present disclosure, or on their own, as will be discussed further herein.

Figure 29:
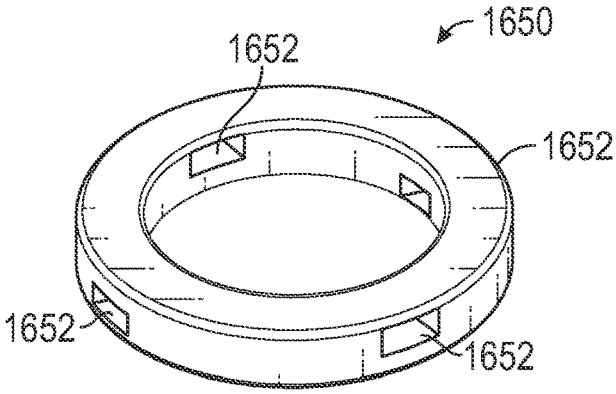
FIG. 29 is a perspective view of an alternate connection ring.

An alternate ring 1650 is shown in perspective view in FIG. 29. Ring 1650 has four openings 1652 spaced equally apart its toroidal body, at 90 degree intervals.

Rings 1600/1650 may be used with rods 1514 in the assembled system 1500 to provide crosswise rods that run perpendicular to the rods 1514, such as rod 1002*a* being perpendicular to rod 1002*b* as shown in FIG. 10. Multiple rings 1600/1650 and rods such as 1514 may be assembled with the bridges 1502, or also as standalone configurations. Some such configurations are shown in FIGS. 30A-30F FIG. 30A illustrates an arrangement in which a fade shot address posture 1700 is shown. A rod 1702 is placed on the ground. Then, an assembly is made of rings 1600/1650 and rods 1704, 1706 parallel to each other and parallel to rod 1708, by virtue of being assembled in openings of the rings 1600/1650. Rods 1710 and 1712 are parallel to each other and perpendicular to rods 1704, 1706, and 1708, also as assembled in openings of the rings 1600/1650 that are offset 90 degrees from the openings for rods 1704 and 1706. The entire assembly, except for rod 1702, is angled slightly to the left of the rod 1702, creating a swing path to ball 1714 of a fade-type swing when feet 1716 are aligned on either side of rod 1712 as shown.

Figures 30A, 30B, 30C:
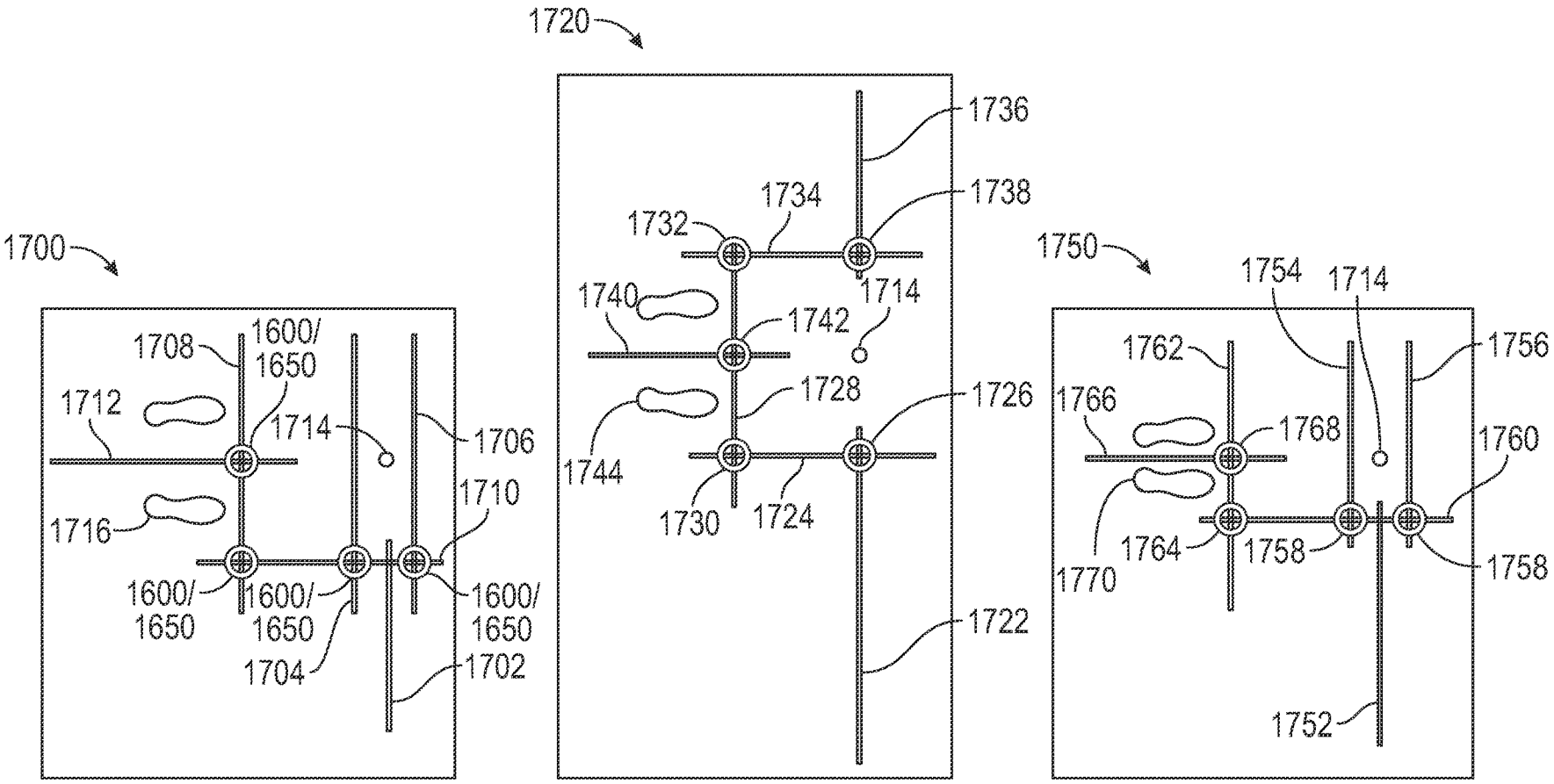
FIG. 30A is a plan view of an arrangement of rods and connection rings for a fade golf shot according to an embodiment of the present disclosure.
FIG. 30B is a plan view of an arrangement of rods and connection rings for a swing alignment of a golf shot according to an embodiment of the present disclosure.
FIG. 30C is a plan view of an arrangement of rods and connection rings for a draw golf shot according to an embodiment of the present disclosure.

FIG. 30B illustrates an arrangement in which a straight shot address posture 1720 is shown. A rod 1722 and a rod 1724 are assembled into offset openings of ring 1726 (e.g., such as ring 1600/1650). Another rod 1728 is assembled perpendicular to rod 1724 and parallel to rod 1722 with ring 1730. Third and fourth rods 1734 and 1736 are assembled, respectively, perpendicular to rod 1728, and parallel to rods 1722 and 1728, with rings 1732 and 1738. A foot alignment rod 1740 is assembled perpendicular to rod 1728 with ring 1742. A golfer's feet are aligned as shown at 1744 to address ball 1712 for a straight swing.

FIG. 30C illustrates an arrangement in which a draw shot address posture 1750 is shown. A rod 1752 is placed on the ground. Then, an assembly is made of rings 1758 and rods 1754, 1756 parallel to each other and parallel to rod 1762, by virtue of being assembled in openings of the rings 1764/1768. Rods 1760 and 1762 are parallel to each other and perpendicular to rods 1754, 1756, and 1762, also as assembled in openings of the rings 1764/1768 that are offset 90 degrees from the openings for rods 1760 and 1762. The entire assembly, except for rod 1752, is angled slightly to the right of the rod 1752, creating a swing path to ball 1714 of a draw-type swing when feet 1770 are aligned on either side of rod 1766 as shown.

Figure 30F:
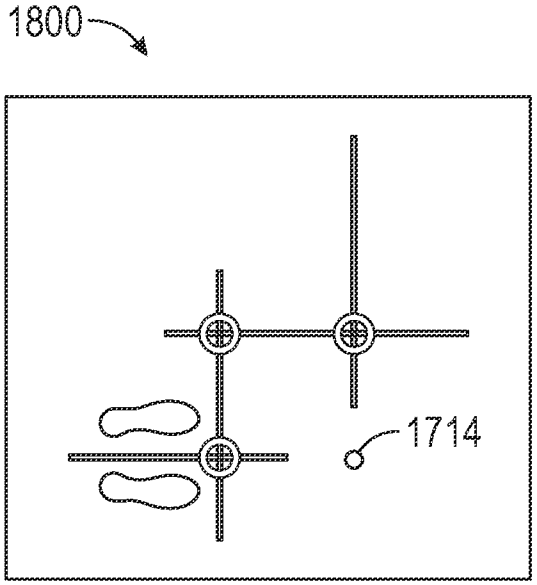
FIGS. 30D, 30E, and 30F are plan views of arrangements of rods and connection rings for golf swing alignments according to embodiments of the present disclosure.
Figure 30E:
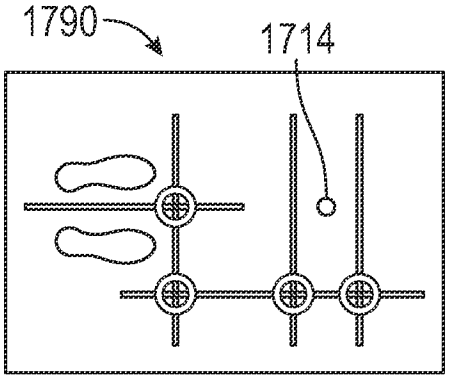
Figure 30D:
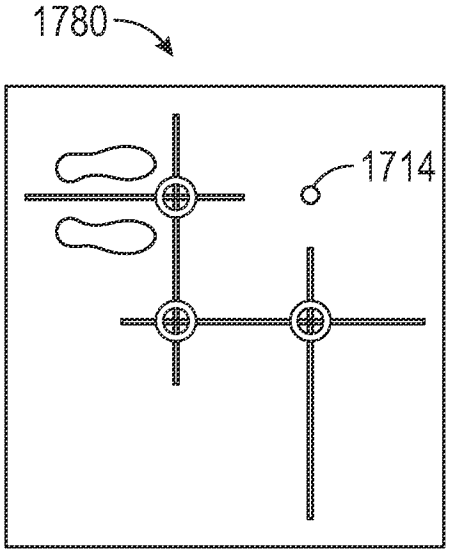

Alternate arrangements of rods (e.g., 1514) and rings (e.g., 1600/1650) are shown for straight swing configurations 1780, 1790, and 1800, in FIGS. 30D, 30E, and 30F, respectively.

Figure 31:
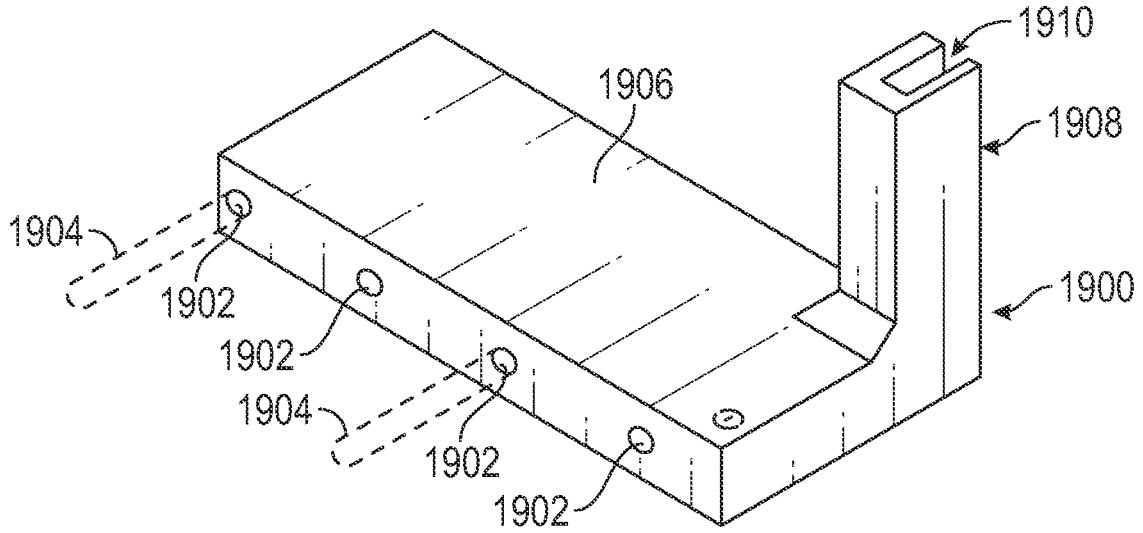
FIG. 31 is a perspective view of a stroke stopper according to an embodiment of the present disclosure.
Figure 32:
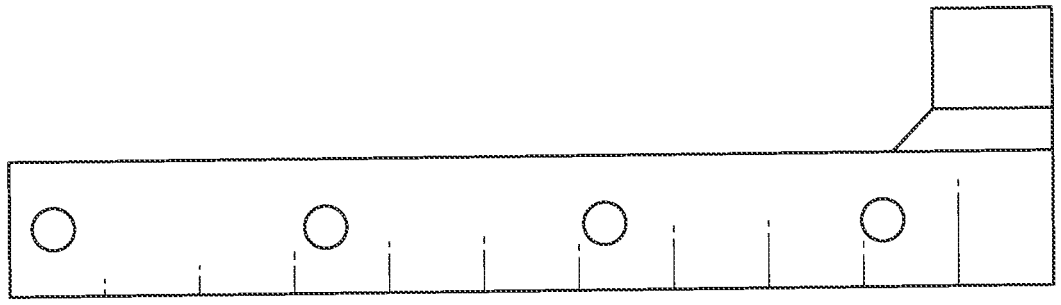
FIG. 32 is a front elevation view of the stroke stopper of FIG. 31.
Figure 33:
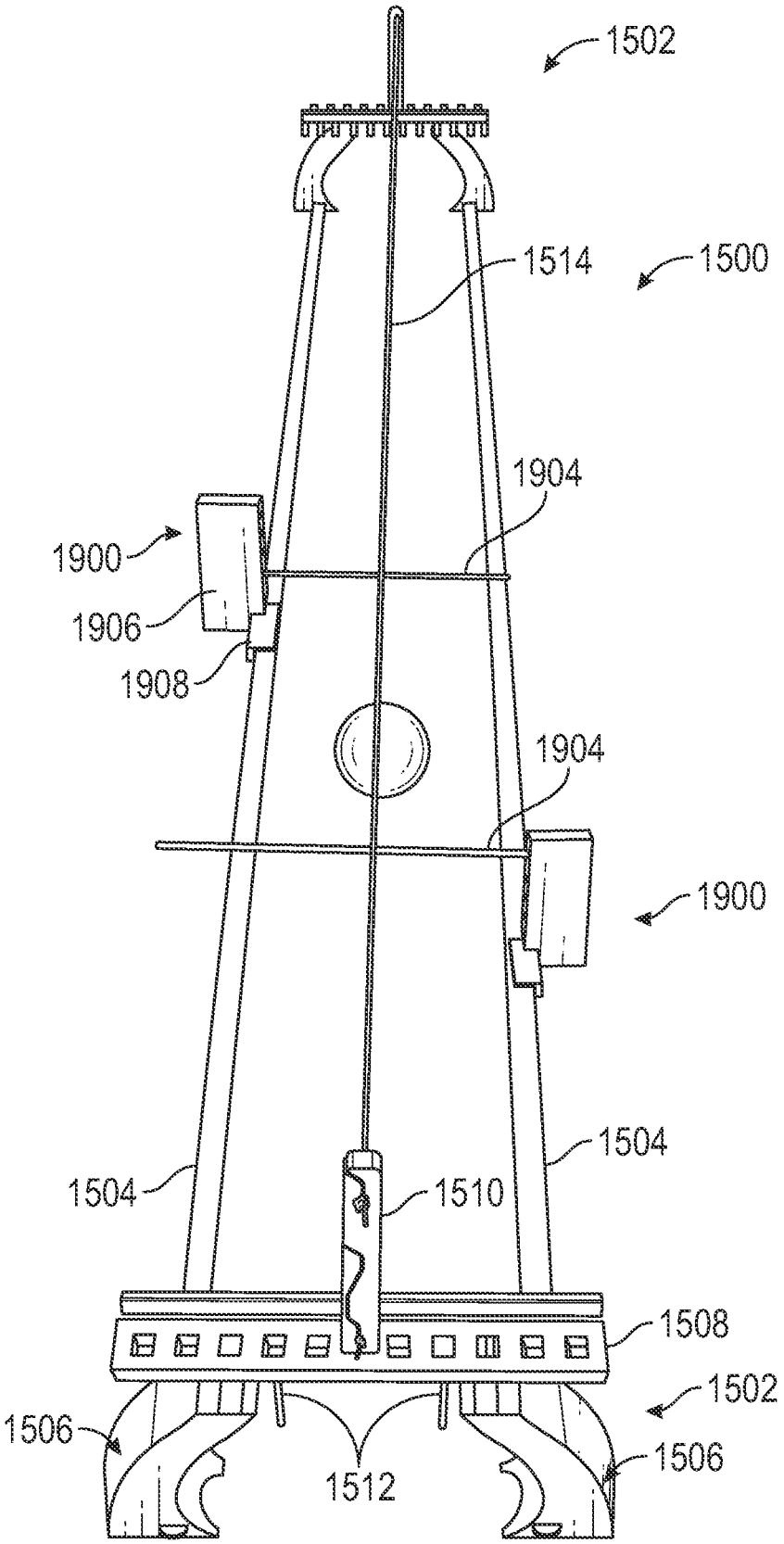
FIG. 33 is a perspective view of a putting aid with stroke stoppers installed according to an embodiment of the present disclosure.

A stroke stopper 1900 is shown in a front perspective view and a front elevation view in FIGS. 31 and 32 respectively. In one embodiment, stroke stopper 1900 is used in conjunction with an assembly such as assembly 1500 to limit a backswing for a putt. A stroke stopper 1900 may be placed over a rod at a desired location to limit the backswing or to limit a follow through swing for a putting stroke. Openings 1902 in stroke stopper 1900 are used for placing rods 1904 (see FIG. 33) therein to extend a stroke stopping barrier across a putting line. Openings 1902 are through holes or openings in body 1906. Connector 1908 slides over a rod/rail 1504 and engages opening/slot 1910 so that the stroke stopper 1900 is adjustably positionable on the rod/rail 1504. Stroke stoppers 1900 are shown placed into a system such as 1500 in FIG. 33. The rods 1904 may be positioned in different openings 1902 to allow for a ball to pass under the rod yet still stop a swing, either a backswing or follow through, of a putter.

Figure 34:
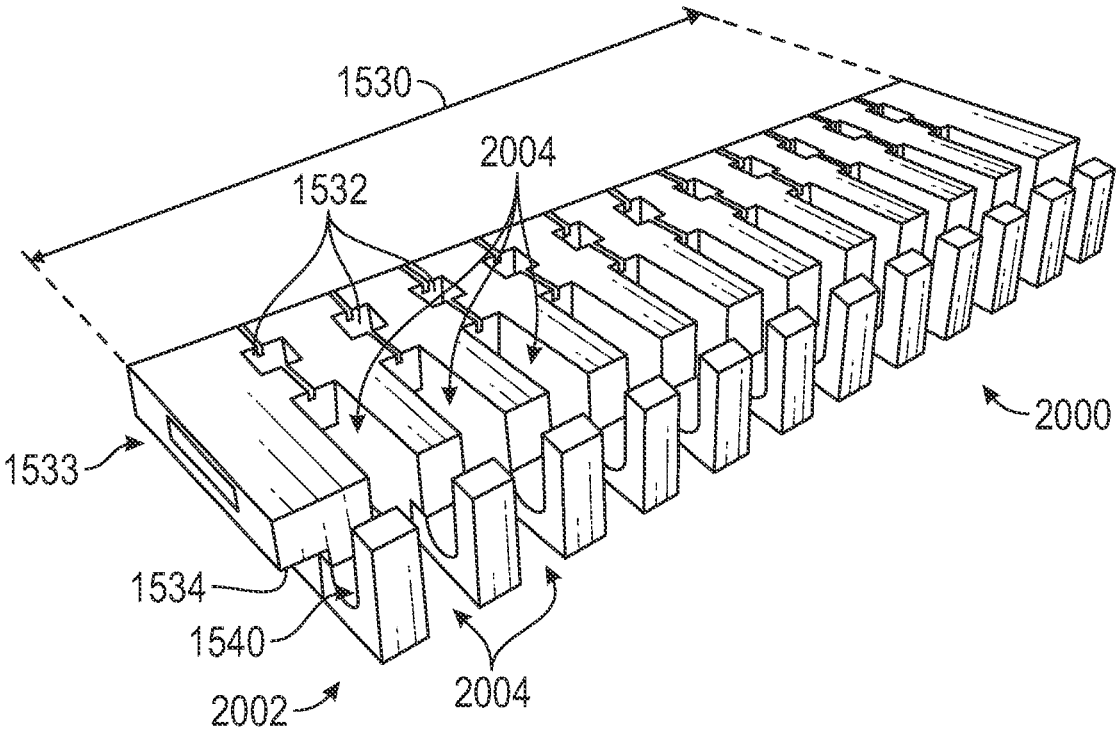
FIG. 34 is an alternate trestle according to an embodiment of the present disclosure.

FIG. 34 illustrates an alternate trestle 200 similar to trestle 1508, but with a different lower section 2002 having openings 2004 that extend through trough 1540 front to back, and also extend into upper section 1533. The openings 2004 are sized to accommodate a target such as target 1512, but also a target such as target 2100 (see FIG. 35) that includes a strike indicator.

Figure 35:
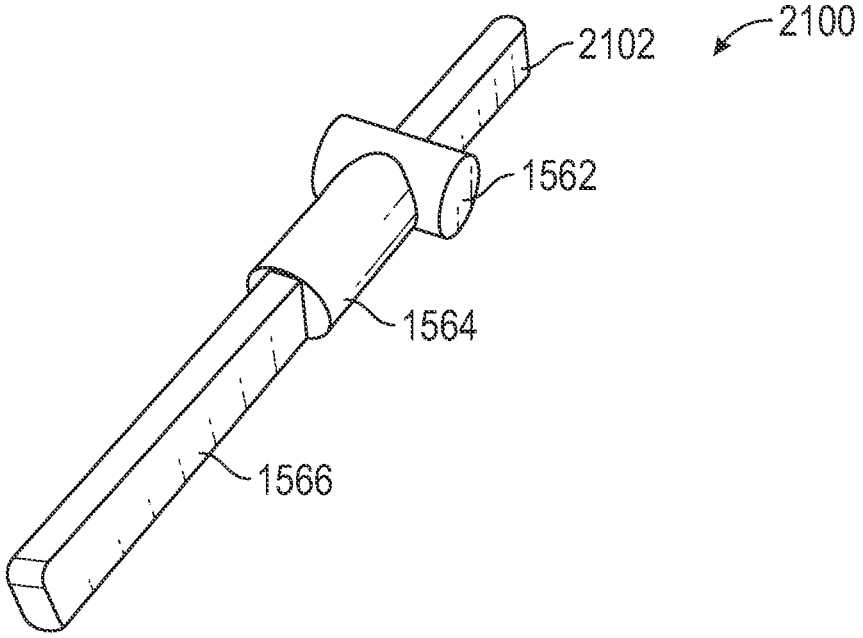
FIG. 35 is an alternate target for use with the alternate trestle of FIG. 34, according to an embodiment of the present disclosure.

FIG. 35 illustrates an alternate target 2100 in perspective view. Target 2100 is mountable in the trough 1540 of trestle 2000 in one of the openings 2004 thereof. The rounded trough 1540 allows a suspending head 1562 of target 2100 to support the target 2100 when target spike 1566 and alignment body 1564 are inserted into an opening 2004 of the trough 1540. A strike indicator 2102 extends from suspending head 1562 in a direction opposite from alignment body 1564. The strike indicator 2102 is free to move within its opening 2004 as the openings extend as shown in FIG. 34 through the lower section 2002 and partially through the upper section 1533 of trestle 2000. The curved edges of suspending head 1562 match that of a bottom of the trough 1540 so that when struck by a golf ball, the target 2100 can rock in the direction of arrow 1516 (see FIG. 15B). Target(s) 2100 provide immediate feedback on a ball strike without affecting the ball and its motion. The strike indicator 2102 in one embodiment extends to a position above a top of the trestle 2000, which makes detecting a ball strike on the target 2100 easily visible.

Embodiments of the present disclosure do not have to be mounted to the ground. Accordingly, the embodiments of the present disclosure may be used indoors or outdoors.

Although the present disclosure has been described with reference to preferred embodiments, workers skilled in the art will recognize that changes may be made in form and detail without departing from the spirit and scope of the disclosure.

What is claimed is:

1. An alignment device for putting, comprising:

two bridges; and at least two rods configured to extend through openings in the bridges to create a putting area bordered by the rods and the bridges;

wherein each bridge comprises a pair of base elements, a trestle that extends between the two base elements, a string support that extends from the trestle, and at least one removable target that is suspended from the trestle;

wherein each trestle has a plurality of trestle openings into which the at least one target is rotatably mounted.

2. The alignment device of claim 1, wherein the pair of base elements are spaced an adjustable distance apart by the trestle.

3. The alignment device of claim 1, wherein a one of the plurality of trestle openings supports the string support therein.

4. The alignment device of claim 1, wherein the at least one target comprises two targets positioned an adjustable distance apart.

5. The alignment device of claim 4, wherein the adjustable distance is a width of a golf hole.

6. The alignment device of claim 1, wherein the at least one target comprises a curved support section and a distal target section, wherein each trestle further comprises a plurality of secondary openings having a curved bottom section matching the curved support section, the plurality of secondary openings sized to accommodate the at least one target.

7. The alignment device of claim 1, wherein each base element comprises an opening at a bottom thereof, the openings of each base element parallel to each other when assembled to the trestle.

8. The alignment device of claim 1, wherein the two bridges are separated and aligned using the rods.

9. The alignment device of claim 1, wherein the rods are flat.

10. The alignment device of claim 1, wherein the rods extend through openings in the base elements, the openings aligning the rods parallel to one another between the two bridges.

11. The alignment device of claim 1, wherein each trestle is removably attachable to its two base elements at a plurality of base element openings in the trestle, allowing the bridge to be wider or narrower.

12. The alignment device of claim 1, wherein each string support attaches to its trestle in one of the plurality of trestle openings, and extends upward, the string support having a plurality of openings to accommodate a string stretched between respective string supports of the two bridges.

13. The alignment device of claim 1, wherein a string or strings are stretched between the two string supports.

14. The alignment device of claim 13, wherein when two strings are used at different heights on the string supports, the strings are aligned so that a top down look aligns a user's eye with a ball placed beneath the strings.

15. The alignment device of claim 1, wherein a single target is used as an aiming point for a putt, or a pair of targets are spaced apart in openings of the other openings.

* * * * *